US005484679A

United States Patent [19]

Spiewak et al.

[11] Patent Number: 5,484,679

[45] Date of Patent: Jan. 16, 1996

[54] LIQUID DEVELOPER COMPOSITIONS WITH MULTIPLE BLOCK COPOLYMERS

[75] Inventors: John W. Spiewak, Webster; James R. Larson, Fairport, both of N.Y.

[73] Assignee: Xerox Corporation, Stamford, Conn.

[21] Appl. No.: 231,086

[22] Filed: Apr. 22, 1994

[51] Int. Cl.$^6$ ..... G03G 9/135; G03G 9/13

[52] U.S. Cl. ..... 430/115; 430/114; 430/119; 430/904

[58] Field of Search ..... 430/115, 112, 430/114, 119, 904

[56] References Cited

U.S. PATENT DOCUMENTS

| | | | |
|---|---|---|---|
| 4,522,908 | 6/1985 | de Winter et al. | 430/115 |
| 4,547,449 | 10/1985 | Alexandrovich et al. | 430/115 |
| 4,707,429 | 11/1987 | Trout | 430/115 |
| 4,925,764 | 5/1990 | Madeleine et al. | 430/110 |
| 5,019,477 | 5/1991 | Felder | 430/115 |
| 5,026,621 | 6/1991 | Tsubuko et al. | 430/109 |
| 5,035,972 | 7/1991 | El-sayed et al. | 430/115 |
| 5,308,731 | 5/1994 | Larson et al. | 430/115 |
| 5,382,492 | 1/1995 | El-sayed et al. | 430/115 |

*Primary Examiner*—Janis L. Dote
*Attorney, Agent, or Firm*—E. O. Palazzo

[57] ABSTRACT

A negatively charged liquid developer comprised of a non-polar liquid, thermoplastic resin particles, a charge adjuvant, pigment, and an ABA polymer charge director wherein A and B represent the polymer segments.

15 Claims, 2 Drawing Sheets

LIQUID DEVELOPER COMPOSITIONS WITH MULTIPLE BLOCK COPOLYMERS

BACKGROUND OF THE INVENTION

This invention is generally directed to liquid developer compositions and, more specifically, to liquid developers containing block polymer negative charge directors comprised of a total of at least three blocks, ammonium A blocks and nonpolar B blocks in various combinations. In embodiments, the charge directors of the present invention are comprised of triblock copolymers of the formula A-B-A wherein the polar A block is an ammonium containing segment and B is a nonpolar block segment which, for example, provides for charge director solubility in the liquid ink fluid like ISOPAR™, and wherein the A blocks have a number average molecular weight range of from about 200 to about 120,000; the B blocks have a number average molecular weight range of from about 2,000 to 190,000; the ratio of $M_w$ to $M_n$ of the triblock copolymer A-B-A is 1 to 5; and the total number average molecular weight of the ABA copolymer is, for example, from about 6,200 to about 300,000, and preferably about 200,000. The developers of the present invention can be selected for a number of known imaging and printing systems, such as xerographic processes, wherein latent images are rendered visible with the liquid developers illustrated herein. The image quality, solid area coverage and resolution for developed images usually require sufficient toner particle electrophoretic mobility. The mobility for effective image development is primarily dependent on the imaging system selected. The electrophoretic mobility is primarily directly proportional to the charge on the toner particles and inversely proportional to the viscosity of the liquid developer fluid. A 10 to 30 percent change in fluid viscosity caused, for instance, by a 5° C. to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor image developer solid area coverage when insufficient toner is transferred to the final substrate and can also lead to image defects such as smears and hollowed fine features. To overcome or minimize such problems, the liquid toners of the present invention were arrived at after substantial research efforts, and which toners result in, for example, sufficient particle charge for image transfer and wherein the developer mobility is maintained within the desired range of the particular imaging system employed. Examples of specific advantages associated with the present invention include increasing the desired negative charge on the developer particles and in embodiments providing a charge director, that is superior since, for example, it provides higher charging, lower conductivity, and allows for lower costs primarily because lower concentrations of charge director are effective as compared to similar AB diblock charge directors like AB tetraalkyl quaternary ammonium block copolymers, AB diblock protonated ammonium salts or zwitter ion containing copolymers, lecithin, and metal salts of petroleum fractions. Some of the aforementioned additives like lecithin contain impurities which can have an adverse effect on their intended function. The aforementioned superior charge can result in improved image development and superior image transfer. The multiple block nature of the invention charge directors is believed to allow for more efficient micelle formation which enables higher particle charging.

Examples of acceptable conductivity and mobility ranges for developers charged with the ammonium salt and zwitterionic triblock copolymer charge directors of the present invention are as illustrated herein. Conductivities, measured at ambient temperature (21° C. to 23° C.), for developers containing one percent toner solids are considered to be in the high range at 14 to 100 pmhos/centimeters. Medium conductivities are from about 6 to about 13 pmhos/centimeters and low conductivities are from 0.1 to about 6 pmhos/centimeters. As conductivities increase into the undesirable high range, excess ions can compete with toner particles of the same charge for development of the latent image giving rise to low developed mass resulting in low print density images. Also, with a low to medium conductivity of less than 14 pmhos/centimeter, the liquid toner or developer of this invention can possess a mobility of between about −1 to $1.99\times10^{-10}$ $m^2/Vs$ and preferably −2.00 to $2.49\times10^{-10}$ $m^2/Vs$, and most preferably −2.50 to $5\times10^{-10}$ $m^2/Vs$. Furthermore, it is desirable that these mobility ranges occur within about 10 days and preferably within 2 days of adding the charge director to the liquid toner.

A latent electrostatic image can be developed with toner particles dispersed in an insulating nonpolar liquid. The aforementioned dispersed materials are known as liquid toners or liquid developers. A latent electrostatic image may be generated by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Liquid developers can comprise a thermoplastic resin and a dispersant nonpolar liquid. Generally, a suitable colorant, such as a dye or pigment, is also present in the developer. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 10 microns (μm) average by area size as measured using the Horiba Capa 500 or 700 particle sizer.

Since the formation of images depends, for example, on the difference of charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors disclosed may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene, and (iv) selected from the group consisting of butadiene and acrylate.

U.S. Pat. No. 5,030,535 discloses a liquid developer composition comprising a liquid vehicle, a charge control additive and toner particles. The toner particles of resin and opitonal charge adjuvant may contain pigment particles, wherein the resin can be selected from the group consisting of polyolefins, halogenated polyolefins and mixtures thereof, and in embodiments thermoplastics generally. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. No. 5,026,621 discloses a toner for electrophotography which comprises as main components a coloring component and a binder resin which is a block copolymer comprising a functional segment (A) of at least one of a fluoroalkylacryl ester block unit or a fluoroalkyl methacryl ester block unit, and a compatible segment (B) of a fluorine-free vinyl or olefin monomer block unit. The functional segment of the block copolymer is oriented to the surface and the compatible segment thereof is oriented to be compatible with other resins and a coloring agent contained in the toner so that the toner is provided with both liquid repelling and solvent soluble properties.

Moreover, in U.S. Pat. No. 4,707,429, the disclosure of which is totally incoporated herein by reference, there are illustrated, for example, liquid developers with an aluminum stearate charge additive. Liquid developers with charge directors are illustrated in U.S. Pat. No. 5,045,425. Additionally, of interest are U.S. Pat. Nos. 4,760,009; 5,034,299 and 5,028,508.

In copending patent application U.S. Ser. No. 986,316 the disclosure of which is totally incorporated herein by reference, there is illustrated a process for forming images which comprises (a) generating an electrostatic latent image; (b) contacting the latent image with a developer comprising a colorant and a substantial amount of a vehicle, which developer has a melting point of at least about 25° C., the contact occurring while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

In copending patent applications and patents and U.S. Ser. No. 065,414 U.S. Pat. Nos. 5,306,591 and 5,308,731, the disclosures of which are totally incorporated herein by reference, there is illustrated the following: a liquid developer comprised of a certain nonpolar liquid, thermoplastic resin particles, a nonpolar liquid soluble ionic or zwitterionic charge director, and a charge adjuvant comprised of an aluminum hydroxycarboxylic acid, or mixtures thereof; U.S. Pat. No. 5,306,591 discloses a liquid developer comprised of thermoplastic resin particles, a charge director, and a charge adjuvant comprised of an imine bisquinone; and U.S. Pat. No. 5,308,731 discloses a liquid developer comprised of a liquid, thermoplastic resin particles, a nonpolar liquid soluble charge director, and a charge adjuvant comprised of a metal hydroxycarboxylic acid.

Illustrated in copending applications U.S. Ser. No. 200,988 is a positively charged liquid developer comprised of thermoplastic resin particles, optional pigment, a charge director, and a charge adjuvant comprised of a polymer of an alkene and unsaturated acid derivative; and wherein the acid derivative contains pendant ammonium groups, and wherein the charge adjuvant is associated with or combined with said resin and said optional pigment; and. U.S. Ser. No. 204,012 is a negatively charged liquid developer comprised of thermoplastic resin particles, optional pigment, a charge director, and an insoluble charge adjuvant comprised of a copolymer of an alkene and an unsaturated acid derivative, and wherein the acid derivative contains pendant fluoroalkyl or pendant fluoroaryl groups, and wherein the charge adjuvant is associated with or combined with said resin and said optional pigment.

DESCRIPTION OF FIGURES

Illustrated in FIG. 1 is the mobility versus conductivity after two days aging for magenta developers containing AB and ABA block copolymer ammonium bromide salt charge directors (Table 2 data).

Illustrated in FIG. 2 is the mobility versus conductivity after 114 and 126 days aging for magenta developers containing AB and ABA block copolymer ammonium bromide salt charge directors (Table 2 data from Example XIV).

Figure 3:
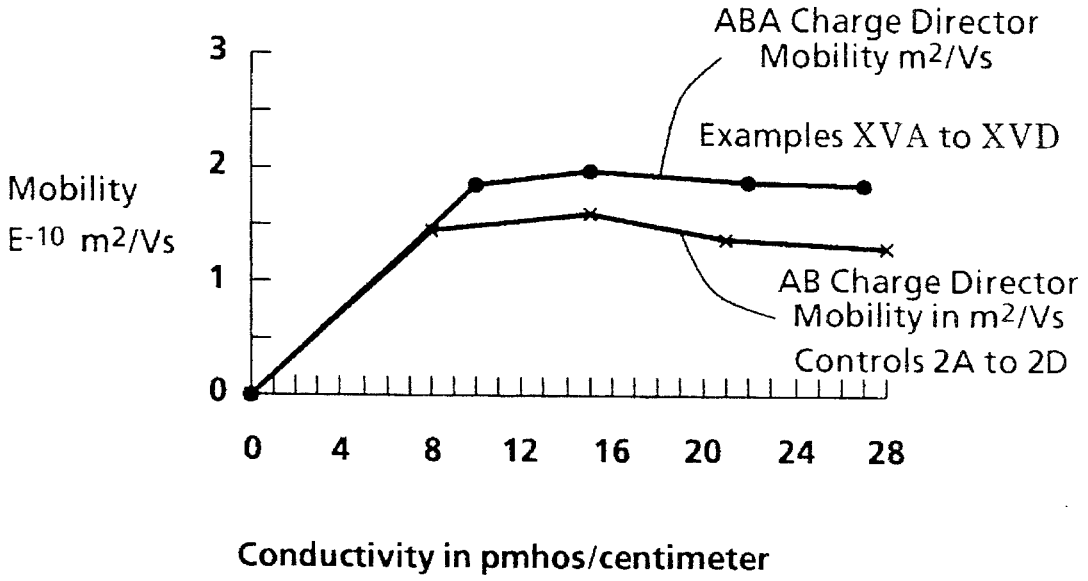

Illustrated in FIG. 3 is the mobility versus conductivity after two days aging for cyan developers containing AB and ABA block copolymer ammonium bromide salt charge directors (Table 4 data).

Figure 4:
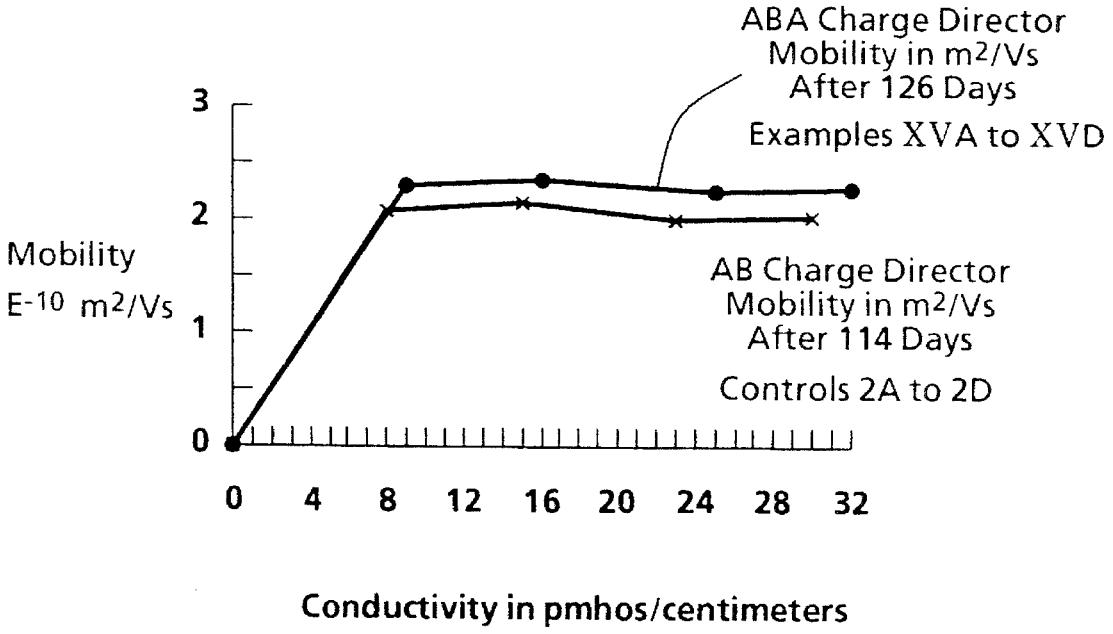

Illustrated in FIG. 4 is the mobility versus conductivity after 114 and 126 days aging for cyan developers containing AB and ABA block copolymer ammonium bromide salt charge directors (Table 4 data).

SUMMARY OF THE INVENTION

It is an object of the present invention to provide liquid developers with many of the advantages illustrated herein.

Another object of the present invention is to provide liquid developers capable of high particle charging and fast toner charging rates.

Another object of the present invention is to provide liquid developers capable of high particle charging and fast toner charging rates at lower charge director concentrations relative to the charging levels and rates obtained for the corresponding AB diblock charged liquid developers.

Another object of the invention is to provide a negatively charged liquid developer wherein there are selected as charge directors zwitterionic quaternary ammonium multiple block copolymers wherein both cationic and anionic sites are covalently bonded within the same polar repeat unit in the polar A block of the block copolymer.

Another object of the invention is to provide a negatively charged liquid developer wherein there are selected as charge directors certain protonated ammonium salt multiple, especially triblock, copolymers.

It is still a further object of the invention to provide a liquid developer wherein developed image defects, such as smearing, loss of resolution and loss of density, are eliminated, or minimized.

Also, in another object of the present invention there are provided negatively charged liquid developers with certain protonated ammonium, ABA triblock charge directors, which are superior in embodiments to, for example, AB diblock protonated ammonium block copolymers since, for example, with the ABA there results higher negative toner particle charge. A superior charge observed after two days with, for example, a 1 percent solids magenta developer charged at 7 percent charge director relative to developer solids with the protonated ammonium multiple (ABA) block copolymer charge director, poly[2-ethylhexyl methacrylate (B block)-co-N,N-dimethyl-N-ethyl methacrylate ammonium bromide (A block)], was $-2.14\times10^{-10}$ $m^2/Vs$ versus $-1.53\times10^{-10}$ $m^2/Vs$ for the corresponding magenta developer charged at the same level with the corresponding protonated ammonium (AB) diblock copolymer charge director of the same composition except for the absence of multiple A blocks. Similarly, superior charge ($-1.97\times10^{-10}$ $m^2/Vs$) was observed after 2 days for a 1 percent solids cyan (PV FAST BLUE™) developer charged at 5 percent charge director solids relative to developer solids with the above protonated ammonium multiple (ABA) block copolymer charge director versus the corresponding cyan developer ($-1.60\times10^{-10}$ $m^2/Vs$) charged at the same level with the above corresponding protonated ammonium (AB) diblock copolymer charge director. The superior charge can result in improved image development and excellent image transfer.

Also, in another object of the present invention there are provided negatively charged liquid developers with certain zwitterionic quaternary ammonium (ABA) multiple block polymer charge directors, which are superior in embodiments to, for example, zwitterionic quaternary ammonium (AB) diblock copolymers since, for example, with the ABA there results higher negative particle charge. The superior charge observed after only 0.5 hour for a 1 percent solids magenta developer charged at 5 percent charge director solids relative to developer solids with the zwitterionic quaternary ammonium (ABA) multiple block copolymer charge director poly[2-ethylhexyl methacrylate (B block)-co-N,N-dimethyl-N-methylenecarboxylate-N-ammonium-ethyl methacrylate (A block)] was $-2.88\times10^{-10}$ $m^2/Vs$ versus $-1.87\times10^{-10}$ $m^2/Vs$ for the corresponding magenta developer charged at 7 percent charge director solids relative to developer solids with the corresponding zwitterionic quaternary ammonium (AB) diblock copolymer charge director of the same composition except for the absence of multiple A blocks. Similarly, superior charge ($-2.39\times10^{-10}$ $m^2/Vs$) was observed after 0.5 hour for a 1 percent solids magenta developer charged at 3 percent charge director solids relative to developer solids with the above zwitterionic quaternary ammonium multiple (AB) block copolymer charge director versus the corresponding magenta developer ($-1.84\times10^{-10}$ $m^2/Vs$) charged at 5 percent charge director solids relative to developer solids with the corresponding zwitterionic quaternary ammonium (AB) diblock copolymer charge director of the same composition except for the absence of multiple A blocks. The superior charge can result in improved image development, excellent image transfer, and excellent image resolution.

Another object of the present invention resides in the provision of negatively charged liquid toners with ammonium multiple block copolymers, and wherein in embodiments enhancement of the negative charge of NUCREL® based toners, especially cyan and magenta toners, is enhanced; and which multiple block polymers ABA can be derived from alkyl or proton quaternized EHMA-DMAEMA (2-ethylhexylmethylmethacrylate-dimethylaminoethylmethacrylate), and wherein the triblocks can possess highly organized micelles.

These and other objects of the present invention can be accomplished in embodiments by the provision of liquid developers with certain charge directors.; In embodiments, the present invention is directed to liquid developers comprised of a toner or thermoplastic resin, pigment, charge additive and a charge director comprised of ammonium multiple block copolymers. In embodiments, the aforementioned charge director contains one or more polar ammonium A blocks and one or more B blocks such that there is a minimum of three blocks and a maximum of ten blocks. The B block constituent or component is nonpolar thereby enabling hydrocarbon solubility. The multiple block copolymers can be obtained from group transfer polymerization, and a subsequent polymer modification reaction of the group transfer prepared multiple block copolymer in which the ammonium site is introduced into the polar A block.

Embodiments of the present invention relate to a liquid electrostatographic developer comprised of (A) a nonpolar liquid having a Kauri-butanol value of from about 5 to about 30, and present in a major amount of from about 50 percent to about 95 weight percent; (B) thermoplastic resin particles with, for example, an average volume particle diameter of from about 0.5 to about 30 microns and preferably 1.0 to about 10 microns in average volume diameter, and pigment; (C) a nonpolar liquid soluble ammonium ABA triblock copolymer charge director; and (D) optionally a charge adjuvant compound.

Examples of suitable nonpolar liquid soluble charge directors selected for the developers of the present invention in various effective amounts, such as from about 0.1 to about 20 weight percent of developer solids include ammonium triblock copolymers ABA wherein the A block is the polar block containing positive charge bearing ammonium sites and the B block is the nonpolar block. The polar and nonpolar blocks in the ammonium multiple block copolymers can be comprised of at least two consecutive polar repeat units or nonpolar repeat units, respectively. When trivalent nitrogen in the polar A block is made tetravalent via protonation, a protonated ammonium salt species is formed as the positive charge bearing site. When the trivalent nitrogen in the polar A block is rendered tetravalent via quaternization with an alkylating agent, a quaternary ammonium species is formed as the positive charge bearing site. If in the formation of a quaternary ammonium species in the polar A block a covalently bonded negative charge bearing site is simultaneously formed, the result is a zwitterionic quaternary ammonium site. Polar A blocks containing at least one protonated ammonium salt or at least one zwitterionic positive charge bearing site in the multiple block copolymer charge directors of this invention can provide charging properties superior to the corresponding AB diblock (2 blocks) copolymer charge directors even when the multiple block (at least 3 blocks) copolymer charge directors are present in the liquid developer at lower concentration than the corresponding AB diblock copolymer charge directors.

Examples of ABA triblock copolymer charge directors include poly[N,N-dimethyl-2-aminoethylmethacrylate hydrogen bromide (A block) co-2-ethylhexyl methacrylate (B block)-co-N,N-dimethyl-2 -aminoethylmethacrylate, hydrogen bromide (A block)], poly[N,N,N-trimethyl- 2-ammoniumethylmethacrylate bromide (A block) co-2 -ethylhexyl methacrylate (B block)-co-N,N-trimethyl-2 -ammoniumethylmethacrylate bromide (A block)], poly[N,N-dimethyl-N-methylenecarboxylate-N-ammoniumethyl methacrylate (A block)-co-2 -ethylhexyl methacrylate (B block)-co-N,N-dimethyl-N-methylenecarboxylate-N-ammoniumethyl methacrylate (A block)], and poly[N,N-dimethyl-N-propylenesulfonate-N-ammoniumethyl methacrylate-co- 2-ethylhexyl methacrylate (B block)-co-N,N-dimethyl-N-propylenesulfonate-N-ammoniumethyl methacrylate (A block)].

One preferred ammonium ABA block copolymer charge director of the present invention contains (1) polar A block(s) which contain the positive ammonium nitrogen and (2) nonpolar B block(s) which has sufficient aliphatic content to enable the block copolymer to more effectively dissolve in the nonpolar liquid with, for example, a Kauri-butanol value of less than about 30, and in embodiments from about 5 to about 30. The total number of blocks in the multiple block copolymer charge directors is at least three. The A block usually possesses a number average molecular weight of from about 200 to about 120,000 and the B block possesses a number average molecular weight range of from about 2,000 to about 190,000 with a $M_w$ to $M_n$ ratio of 1 to 5.

The A block precursor polyamine is usually prepared from an amine containing monomer which after polymerization is protonated by treatment with the appropriate acid or is alkylated by treatment with the appropriate alkylating agent to form the ammonium A block. Examples of selected A block precursors include polymers prepared from different monomers of 1) $CH_2{=}CRCO_2R^1$ wherein R is hydrogen, or alkyl, aryl, or alkylaryl of 1 to about 20 carbons with or without heteroatoms wherein heteroatoms include oxygen, sulfur, phosphorous, nitrogen, fluorine, chlorine, bromine, iodine,, silicon, and the like; and $R^1$ is alkyl of 1 to about 20 carbons where the terminal end of $R^1$ is of the general formula $-N(R^2)_2$, where N is nitrogen, $R^2$ is alkyl or cycloalkyl of 1 to about 30 carbons, aryl or alkylaryl of 6 to about 24 carbons; or 2) 2,3, or 4-vinylpyridine wherein the ring carbon atoms not substituted with the vinyl group are substituted with $R^2$. Examples of specific monomers selected as A blocks include N,N-dimethylamino-N-2-ethyl methacrylate, N,N-diethylamino-N-2-ethyl methacrylate, N,N-dimethylamino-N-2-ethyl acrylate, N,N-diethylamino-N- 2-ethyl acrylate, N,N-morpholino-N-2-ethyl methacrylate, N,N-morpholino-N-2-ethyl acrylate, 4-vinyl-pyridine, 2-vinyl-pyridine, 3-vinyl pyridine, and the like. B blocks include polymers prepared from one to five different monomers such as those represented by the general formulas, $CH_2{=}CHR^3$ wherein $R^3$ is as follows excluding hydrogen, $CH_2{=}CR^3CO_2R^4$, wherein $R^3$ is hydrogen or saturated or unsaturated, linear or branched alkyl of 1 to 30 carbons, or alkylaryl or cycloalkylaryl of 10 to about 30 carbons with or without heteroatoms and $CH_2{=}CHCO_2R^4$, wherein $R^4$ is saturated or unsaturated, linear or branched, alkyl or cycloalkyl of 4 to about 30 carbons; or saturated or unsaturated, linear or branched, alkylaryl or cycloalkylaryl of 10 to 30 carbons with or without heteroatoms.

Examples of monomers selected for preparing B blocks in the range of 0.1 to 100 percent include 2-ethylhexylmethacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, methoxybutadiene, isobutylene, cyclohexylethylene, cyclohexenylethylene, myrcene, piperylene, 1-dodecene, 4-tert butylstyrene, 3-tert butylstyrene, cyclooctene, cyclopentene, norbornene, and the like. Optional nonpolar B blocks can be comprised of polymers prepared from at least one monomer selected from the group consisting of $CH_2{=}CHCON(R^4)_2$ and $CH_2{=}CR^3CON(R^4)_2$ where $R^3$ and $R^4$ are as illustrated herein.

Examples of acids in the range of 0.1 to 100 percent that may be selected to convert the amine containing A block precursor to the ammonium A block include acids with a pKa of less than or equal to about 4.5, preferably less than 3.0, and from, for example, 1 to about 3. Acids include hydrobromic acid, hydrochloric acid, hydrofluoric acid, hydroiodic acid, phosphoric acid, sulfuric acid, tetrafluoroboric acid, dichloroacetic acid, difluoroacetic acid, trichloroacetic acid, trifluoroacetic acid, tetrafluoroterephthalic acid, tetrafluorosuccinic acid, hexafluoroglutaric acid, hexafluorphosphoric acid, 3-methylsalicylic acid, 5-chlorosalicylic acid, butanesulfonic acid, dodecanesulfonic acid, methanesulfonic acid, trifluoromethanesulfonic acid, p-toluenesulfonic acid, benzenesulfonic acid, dodecylbenzenesulfonic acid and naphthalene-1,5-disulfonic acid.

Alkylating agents in the amount range of 0.1 to 100 percent that may be selected to convert the amine containing A block precursor to the ammonium A block include methyl p-toluenesulfonate, methyl trifluoromethanesulfonate, ethyl p-toluenesulfonate, methyl bromide, methyl chloride, methyl iodide, butyl bromide, dodecyl chloride, dodecyl iodide, allyl bromide, benzyl bromide, methyl sulfate, methyl hydrogen sulfate, triethyloxonium tetrafluoroborate, trimethyloxonium tetrafluoroborate, trimethyl phosphate and the like.

Alkylating agents in the amount range of 0.1 to 100 percent that may be selected to convert the amine containing A block precursor to a zwitterionic ammonium A block include sodium iodoacetate, sodium bromoacetate, lithium iodoacetate, lithium bromoacetate, 1,3-propanesulfone, 2,4-butanesulfone, 1,4-butanesulfone, sodium 2-bromoethanesulfonate, sodium 2-bromoethanesulfinate, sodium 2-bromoethanehydrogen phosphonate, disodium 2-bromoethane phosphonate, sodium 2-bromoethane-P-methyl phosphinate, sodium 2-bromoethane-P-hydrogen phosphinate, pivalolactone, and the like.

In embodiments, the ammonium triblock copolymer can be prepared by the polymerization of ammonium A block monomers with the nonpolar B block monomers.

Examples of ammonium triblock copolymers selected in the range of 0.1 to 100 percent (nonpolar B block named first then polar A block) include poly[2-ethylhexyl methacrylate (B block)-co-N,N-dimethyl-N-ethyl methacrylate ammonium bromide (A block)], poly[2-ethylhexyl methacrylate-co-N,N-dimethyl-N-ethyl methacrylate ammonium tosylate], poly[2-ethylhexyl methacrylate-co-N,N-dimethyl-N-ethyl methacrylate ammonium chloride], poly[2-ethylhexyl acrylate-co-N,N-dimethyl-N-ethyl methacrylate ammonium bromide], poly[2-ethylhexyl acrylate-co-N,N-dimethyl-N-ethyl acrylate ammonium bromide], poly[2-ethylhexyl acrylate-co-N,N-dimethyl-N-ethyl methacrylate ammonium tosylate], poly[2 -ethylhexyl acrylate-co-N,N-dimethyl-N-ethyl acrylate ammonium tosylate], poly[2-ethylhexyl acrylate-co-N,N-dimethyl-N-ethyl methacrylate ammonium chloride], poly[2-ethylhexyl acrylate-co-N,N-dimethyl-N-ethyl acrylate ammonium chloride], poly[N,N-dibutyl methacrylamide-co-N,N-dimethyl-N-ethyl methacrylate ammonium bromide], poly[N,N-dibutyl methacrylamide-co-N,N-dimethyl-N-ethyl methacrylate ammonium tosylate], poly [N,N-dibutylacrylamide-co-N,N-dimethyl-N-ethyl methacrylate ammonium bromide], poly[N,N-dibutylacrylamide-co-N,N-dimethyl-N-ethyl methacrylate ammonium tosylate], poly[2-ethylhexyl methacrylate-co-4-vinyl-N,N-dimethylanilinium bromide], poly[2-ethylhexyl methacrylate-co-4-vinyl-N,N-dimethylanilinium tosylate], poly[2-ethylhexyl methacrylate-co-ethylene-N-methyl ammonium bromide], and poly[2 -ethylhexyl methacrylate-co-propylene-N-methyl ammonium bromide].

Examples of ABA block copolymer charge directors containing quaternary ammonium zwitter ions (nonpolar B block named first then polar A block) in the range of 0.1 to 100 percent include poly[2-ethylhexyl methacrylate (B block)-co-N,N-dimethyl-N-methylenecarboxylate-N-ammoniumethyl methacrylate (A block)], poly[2-ethylhexyl methacrylate (B block)-co-N,N-dimethyl-N-propylenesulfonate-N-ammoniumethyl methacrylate (A block)], poly(2-ethylhexyl methacrylate-co-N,N-dimethyl-N-propylenephosphonate-N-ammoniumethyl methacrylate), poly(2-ethylhexyl methacrylate-co-N,N-dimethyl-N-propylenephosphinate-N-ammoniumethyl methacrylate), poly(2-ethylhexyl methacrylate-co-N,N-dimethyl-N-propylenesulfinate-N-ammoniumethyl methacrylate), poly(2 -ethylhexyl methacrylate-co-N,N-diethyl-N-methylenecarboxylate-N-ammoniumethyl methacrylate), poly(2-ethylhexyl methacrylate-co-N,N-diethyl-N-propylenesulfonate-N-ammoniumethyl methacrylate), poly(2 -ethylhexyl methacrylate-co-N,N-dimethyl-N-butylenephosphonate-N-ammoniumethyl methacrylate), poly(2-ethylhexyl methacrylate-co-N,N-dimethyl-N-decamethylenephosphonate-N-ammoniumethyl methacrylate), poly(2-ethylhexyl methacrylate-co-N,N-dimethyl-N-decamethylenephosphinate-N-ammoniumethyl methacrylate), poly(2 -ethylhexyl methacrylate-co-N,N-dimethyl-N:butylenecarboxylate-N-ammoniumethyl methacrylate), poly(2-ethylhexyl methacrylate-co-N,N-dimethyl-N-ethyleneoxyethylenecarboxylate-N-ammoniumethyl methacrylate), poly(2-ethylhexyl methacrylate-co-N,N-dimethyl-N-ethyleneoxyethylenesulfonate-N-ammoniumethyl methacrylate), poly(2 -ethylhexyl methacrylate-co-N,N-dimethyl-N-ethyleneoxyethylenephosphonate-N-ammoniumethyl methacrylate), poly(N,N-dibutylmethacrylamido-co-N,N-dimethyl-N-methylenecarboxylate-N-ammoniumethyl methacrylate), poly(N,N-dibutylmethacrylamido-co-N,N-dimethyl-N-propylenesulfonate-N-ammoniumethyl methacrylate), poly(N,N-dibutylmethacrylamido-co-N,N-dimethyl-N-propylenephosphonate-N-ammoniumethyl methacrylate), and poly(N,N-dibutylmethacrylamido-co-N,N-dimethyl-N-propylenephosphinate-N-ammoniumethyl methacrylate), and poly(N,N-dibutylmethacrylamido-co-N,N-dimethyl-N-propylenesulfinate-N-ammoniumethyl methacrylate). For the above examples, the corresponding acrylate copolymer, instead of the methacrylate copolymer, could also be employed as suitable nonpolar liquid soluble zwitterionic ammonium multiple block copolymer charge directors. Additional suitable examples of nonpolar liquid soluble multiple block zwitterionic ammonium copolymer charge directors (polar A block named first then nonpolar B block) include poly(4-vinylpyridinium-N-methylenecarboxylate-co-2-ethylhexyl methacrylate), poly(4-vinylpyridinium-N-propylenesulfonate-co- 2-ethylhexyl methacrylate), poly(4-vinylpyridinium-N-propylenephosphonate-co-2-ethylhexyl methacrylate), poly(4 -vinylpyridinium-N-propylenephosphinate-co-2-ethylhexyl methacrylate), poly(4-vinylpyridinium-N-propylenesulfinate-co-2-ethylhexyl methacrylate), poly(4-vinylpyridinium-N-ethyleneoxyethylenecarboxylate-co- 2-ethylhexyl methacrylate), poly(4 -vinylpyridinium-N-ethyleneoxyethylenesulfonate-co-2-ethylhexyl methacrylate), poly(4 -vinylpyridinium-N-ethyleneoxyethylenephosphonate-co-2-ethylhexyl methacrylate), poly[4-vinylpyridinium-N-methylenecarboxylate-co-p-tertiary butylstyrene), and the like. In the aforementioned pyridinium examples, additional examples of nonpolar liquid soluble zwitterionic ABA triblock copolymer charge directors include poly(2-vinylpyridinium-N-methylenecarboxylate-co- 2-ethylhexyl methacrylate), poly(2 -vinylpyridinium-N-propylenesulfonate-co-2-ethylhexyl methacrylate), poly(2-vinylpyridinium-N-propylenephosphonate-co-2-ethylhexyl methacrylate), poly(2-vinylpyridinium-N-propylenephosphinate-co-2 -ethylhexyl methacrylate), poly(2-vinylpyridinium-N-propylenesulfinate-co-2-ethylhexyl methacrylate), poly(2-vinylpyridinium-N-ethyleneoxyethylenecarboxylate-co- 2-ethylhexyl methacrylate), poly(2 -vinylpyridinium-N-ethyleneoxyethylenesulfonate-co-2-ethylhexyl methacrylate), poly(2-vinylpyridinium-N-ethyleneoxyethylenephosphonate-co-2-ethylhexyl methacrylate), poly[3 -vinylpyridinium-N-methylenecarboxylate-co-p-tertiary butylstyrene) and poly(3-vinylpyridinium-N-methylenecarboxylate-co-2-ethylhexyl methacrylate), poly(3-vinylpyridinium-N-propylenesulfonate-co-2 -ethylhexyl methacrylate), poly(3-vinylpyridinium-N-propylenephosphonate-co- 2-ethylhexyl methacrylate), poly(3-vinylpyridinium-N-propylenephosphinate-co-2-ethylhexyl methacrylate), poly(3-vinylpyridinium-N-propylenesulfinate-co-2-ethylhexyl methacrylate), poly(3-vinylpyridinium-N-ethyleneoxyethylenecarboxylate-co-2-ethylhexyl methacrylate), poly(3-vinylpyridinium-N-ethyleneoxyethylenesulfonate-co- 2-ethylhexyl methacrylate), poly(3 -vinylpyridinium-N-ethyleneoxyethylenephosphonate-co-2-ethylhexyl methacrylate), poly[3-vinylpyridinium-N-methylenecarboxylate-co-p-tertiary butylstyrene), and the like.

Examples of nonpolar liquid soluble multiple block quaternary ammonium copolymer charge directors (nonpolar B block named first then polar A block) include poly[2-ethylhexyl methacrylate (B block)-co-N,N,N-trimethyl-N-ethyl methacrylate ammonium bromide (A block)], poly[2 -ethylhexyl methacrylate-co-N,N-dimethyl-N-butyl-N-ethyl methacrylate ammonium bromide], poly[2-ethylhexyl methacrylate-co-N,N-dimethyl-N-lauryl-N-ethyl methacrylate ammonium bromide], poly[2-ethylhexyl methacrylate-co-N,N-dimethyl-N-stearyl-N-ethyl methacrylate ammonium bromide], poly[2-ethylhexyl methacrylate-co-N,N-dimethyl-N-methyl-N-ethyl methacrylate ammonium tosylate], poly[2-ethylhexyl methacrylate-co-N,N-dimethyl-N-butyl-N-ethyl methacrylate ammonium tosylate], poly[2-ethylhexyl methacrylate-co-N,N-dimethyl-N-ethyl-N-ethyl methacrylate ammonium tetrafluoroborate], poly[2-ethylhexyl methacrylate-co-N,N,N-trimethyl-N-ethyl methacrylate ammonium phosphate], and poly[2-ethylhexyl methacrylate-co-N,N,N-trimethyl-N-ethyl methacrylate ammonium sulfate].

Examples of useful ABA triblock copolymer charge directors include poly[N,N-dimethyl-2-aminoethylmethacrylate hydrogen bromide (A block) co-2-ethylhexyl methacrylate (B block)-co-N,N-dimethyl-2 -aminoethylmethacrylate hydrogen bromide (A block)], poly[N,N,N-trimethyl- 2-ammoniumethylmethacrylate bromide (A block) co-2 -ethylhexyl methacrylate (B block)-co-N,N-trimethyl-2 -ammoniumethylmethacrylate bromide (A block)], poly[N,N-dimethyl-N-methylenecarboxylate-N-ammoniumethyl methacrylate (A block)-co-2 -ethylhexyl methacrylate (B block)-co-N,N-dimethyl-N-methylenecarboxylate-N-ammoniumethyl methacrylate (A block)], and poly[N,N-dimethyl-N-propylenesulfonate-N-ammoniumethyl methacrylate-co- 2-ethylhexyl methacrylate (B block)-co-N,N-dimethyl-N-propylenesulfonate-N-ammoniumethyl methacrylate (A block)].

One preferred ammonium ABA triblock copolymer charge director of the present invention includes (1) polar A block(s) which contain the positive ammonium nitrogen, and (2) nonpolar B block(s) which has sufficient aliphatic content, usually a minimum of four carbons with a maximum of about 100 carbons, to enable the block copolymer to more effectively dissolve in the nonpolar liquid having a Kauri-butanol value of less than about 30, and in embodiments from about 5 to about 30. The total number of blocks in, as indicated herein, these multiple block copolymer charge directors is at least three. The A block(s) can have a number average molecular weight range of from about 200 to about 120,000 and the B block(s) can have a number average molecular weight range of from about 2,000 to about 190,000. Based on the above range of number average degree of polymerization (DP) for the polar A block(s), the mole percent of all the polar A block repeat units in the invention charge director multiple block copolymers can range from 0.4 to 83.3 percent. Based on the above range of number average degree of polymerization (DP) for the nonpolar B block(s), the mole percent of all the nonpolar B block repeat units in the charge director multiple block copolymers of this invention can satisfactorily range from 16.7 to 99.6 percent. The preferred repeat unit content of the polar A block(s) is 60 to 5 mole percent and is more preferably at 40 to 10 mole percent, and the preferred repeat unit content of the nonpolar B block(s) is 40 to 95 mole percent and is more preferably at 60 to 90 mole percent. Amine nitrogen protonation or alkylation to form the ammonium polar A block repeat unit can be at least 80 mole percent and preferably at least 90 mole percent for satisfactory charge director performance.

The ABA charge director can be selected for the liquid developers in various effective amounts, such as for example from about 0.5 percent to 100 percent by weight relative to developer solids and preferably 2 percent to 20 percent by weight relative to developer solids. Developer solids include toner resin, pigment, and optional charge adjuvant. Without pigment, the developer may be selected for the generation of a resist, or a printing plate, and the like.

Examples of liquid carriers or vehicles selected for the developers of the present invention include a liquid with viscosity of from about 0.5 to about 500 centipoise, and preferably from about 1 to about 20 centipoise, and a resistivity greater than or equal to $5\times10^9$ ohm/centimeters, such as $10^{13}$ ohm/centimeters, or more. Preferably, the liquid selected in embodiments is a branched chain aliphatic hydrocarbon. A nonpolar liquid of the ISOPAR® series available from Exxon Corporation may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR® series available from Exxon Corporation, the SOLTROL® series available from the Phillips Petroleum Company, .and the SHELLSOL® series available from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight. In embodiments of the present invention: the A block of the charge director can be an alkyl, aryl, or alkylaryl ammonium moiety; the thermoplastic resin polymers can be comprised of a methacrylate polymer; the nonpolar liquid component can be present in an amount of from about 85 percent to about 99.9 percent by weight based on the total weight of the developer containing the aforementioned liquid and developer solids of resin particles, pigment and charge adjuvant, and charge director. Also, in embodiments, the charge director can be present in an amount of from about 0.25 to about 1,500 milligrams gram of the developer solids comprised of resin particles, pigment particles and charge adjuvant; and! from about 0.1 to about 40 weight percent of the charge adjuvant based on the total weight of developer solids can be present; the nonpolar liquid can be an aliphatic hydrocarbon comprised of a mixture of normal hydrocarbons with from about 12 to about 16 carbon atoms and the weight average molecular weight to number average molecular weight ratio of said triblock is about 1 to 5.

Various suitable thermoplastic toner resins can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX® resins, E. I. DuPont de Nemours and Company, Wilmington, Del.); copolymers of ethylene and an a-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E. I. DuPont de Nemours arid Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E. I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL® 599, NUCREL® 699, or NUCREL® 960 can be selected as the thermoplastic resin.

The liquid developers of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference, and more specifically, the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue: 3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

To increase the toner particle charge and, accordingly, increase the mobility and transfer latitude of the toner particles, charge adjuvants can be added to the toner. For example, adjuvants, such as metallic soaps, like aluminum or magnesium stearate or octoate, fine particle size oxides, such as oxides of silica, alumina, titania, and the like, paratoluene sulfonic acid, and polyphosphoric acid, may be added. Negative charge adjuvants primarily increase the negative charge or decrease the positive charge of the toner particle, while the positive charge adjuvants increase the positive charge of the toner particles. With the invention of the present application, in embodiments the adjuvants or charge additives can be comprised of the metal catechol and aluminum hydroxy acid complexes illustrated in copending patent applications U.S. Pat. Nos. 5,306,591 and 5,308,731, the disclosures of which are totally incorporated herein by reference, and which additives in combination with the charge directors of the present invention have, for example, the following advantages over the aforementioned prior art charge additives: improved toner charging characteristics, namely, an increase in particle charge, as measured by ESA mobility, from −1.4 E-10 m2/Vs to −2.3 E-10 m2/Vs, that results in improved image development and transfer, from 80 percent to 93 percent, to allow improved solid area coverage, and a transferred image reflectance density of 1.2 to 1.3. The adjuvants can be added to the toner particles in an amount of from about 0.1 percent to about 15 percent of the total developer solids and preferably from about 1 percent to about 5 percent of the total weight of solids contained in the developer.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound, reference U.S. Pat. No. 4,497,208, the disclosure of which is totally incorporated herein by reference. This technique is particularly useful for nonaqueous dispersions because the measurements can be made at high volume loadings, for example greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin and colorant in a manner that the resulting mixture contains, for example, about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding a charge adjuvant compound to the dispersion; and diluting the dispersion, followed by mixing with the charge director.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. The charge director can be added at any point in the toner preparation, but is preferably added after the particles have been reduced to their desired size. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. The temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids wherein solids include resin, charge adjuvant, and pigment concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of developers that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference U.S. Pat. No. 5,306,591, the disclosure of which is totally incorporated herein by reference, the image is developed with the liquid toner illustrated herein by, for example, immersion of the photoconductor therein, followed by transfer and fixing of the image, or transfer to an intermediate belt, a second transfer to a substrate like paper, followed by fixing.

The present invention is illustrated in the following nonlimiting Examples, it being understood that these Examples are intended to be illustrative only and that the invention is not intended to be limited to the materials, conditions, process parameters and the like recited herein. All parts and percentages are by weight unless otherwise indicated. Control Examples are also provided. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science, Hopkinton, Mass.). The system was calibrated in the aqueous mode per manufacturer's recommendation to give an ESA signal corresponding to a zeta potential of −26 millivolts for a 10 percent (v/v) suspension of LUDOX™ (DuPont). Tile system was then set up for nonaqueous measurements. The toner particle mobility is dependent on a number of factors including particle charge and particle size. The ESA system also calculates the zeta potential which is directly proportional to toner charge and is independent of particle size. Particle size was measured by the Horiba CAPA-500 and 700 centrifugal automatic particle analyzer, manufactured by Horiba instruments, Inc., Irvine, Calif.

EXAMPLE I

LIQUID TONER PREPARATION 1

One hundred and seventy-five (175.0) grams of NUCREL 599®, a copolymer of ethylene and methacrylic acid with a melt index at 190° C. of 500 dg/minute, availabie from E. I. DuPont de Nemours & Company, Wilmington, Del., 45.4 grams of the cyan pigment PV FAST BLUE™, 6.8 grams of aluminum stearate WITCO 22,™ available from Witco Company, and 307.4 grams of NORPAR 15®, carbon chain of 15 average, available from Exxon Corporation, were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 86° to 96° C. for 2 hours and cooled by running water through the attritor jacket to 16° C. An additional 980.1 grams of NORPAR 15® were added, and ground in the attritor for an additional 4.5 hours. An additional 1,536 grams of NORPAR 15® were added and the mixture was separated by the use of a metal grate from the steel balls yielding a liquid toner concentrate of 7.13 percent solids wherein solids include resin, WITCO 22™, charge adjuvant, and pigment and 92.87 percent of NORPAR 15®. The particle diameter was 2.12 microns average by area as measured with a Horiba Cappa 500.

EXAMPLE II

LIQUID TONER PREPARATION 2

One hundred and seventy point four (170.4) grams of NUCREL 599® (a copolymer of ethylene and methacrylic acid with a melt index at 190° C. of 500 dg/minute, available from E. I. DuPont de Nemours & Company, Wilmington, Del.), 50.0 grams of the magenta pigment FANAL PINK™, 6.8 grams of aluminum stearate WITCO 22™ charge adjuvant (Witco) and 307.4 grams of NORPAR 15®, carbon chain of 15 average (Exxon Corporation), were added to a Union Process 1S attritor (Union Process Company, Akron, Ohio) charged with 0.1875 inch (4.76 millimeters) diameter carbon steel balls. The mixture was milled in the attritor which was heated with running steam through the attritor jacket at 85° to 96° C. for 2 hours and cooled by running water through the attritor jacket to 15° C. An additional 980.1 grams of NORPAR 15® were then added, and the resulting mixture was ground in the attritor for an additional 4.5 hours. An additional 1,532 grams of NORPAR 15® were added and the mixture was separated by the use of a metal grate from the steel balls yielding a liquid toner concentrate of 7.17 percent solids wherein solids include resin, charge adjuvant, and pigment and 92.83 percent of NORPAR 15®. The particle diameter was 2.18 micrometers average by area as measured with the Horiba Cappa 500.

EXAMPLE III

LIQUID TONER PREPARATION 3

One hundred and sixty five point three (165.3) grams of NUCREL 599® (a copolymer of ethylene and methacrylic acid with a melt index at 190° C. of 500 dg/minute, available from E. I. DuPont de Nemours & Company, Wilmington, Del.), 56.8 grams of the magenta pigment FANAL PINK™, 5.1 grams of aluminum stearate WITCO 22™ (Witco) and 307.4 grams of NORPAR 15®, carbon chain of 15 average (Exxon Corporation), were added to a Union Process 1S attritor (Union Process Company, Akron, Ohio) charged with 0.1875 inch (4.76 millimeters) diameter carbon steel balls. The resulting mixture was milled in the attritor which was heated with running steam through the attritor jacket at 83° to 96° C. for 2 hours and cooled by running water through the attritor jacket to 23° C.; an additional 980.1 grams of NORPAR 15® were added, and ground in the attritor for an additional 4.5 hours. An additional 1,532 grams of NORPAR 15® were added and the mixture was separated by the use of a metal grate from the steel balls yielding a liquid toner concentrate of 7.19 percent solids wherein solids include resin, charge adjuvant, and pigment and 92.81 percent of NORPAR 15®. The particle diameter was 2.02 microns average by area as measured with the Horiba Cappa 500.

EXAMPLE IV

LIQUID TONER PREPARATION 4

One hundred and seventy five (175.0) grams of NUCREL 599®, a copolymer of ethylene and methacrylic acid with a melt index at 190° C. of 500 dg/minute, available from E. I. DuPont de Nemours & Company, Wilmington, Del., 45.4 grams of the cyan pigment PV FAST BLUE™, 6.8 grams of aluminum stearate WITCO 22™, available from Witco Company, and 307.4 grams of NORPAR 15®, carbon chain of 15 average (available from Exxon Corporation), were added to a Union Process 15 attritor (Union Process Company, Akron, Ohio) charged with 0.1875 inch (4.76 millimeters) diameter carbon steel balls. The mixture was milled in the attritor which was heated with running steam through the attritor jacket at 86° to 96° C. for 2 hours and cooled by running water through the attritor jacket to 16° C., an additional 980.1 grams of NORPAR 15® were added, and ground in the attritor for an additional 4.5 hours. An additional 1,530 grams NORPAR 15® were added and the mixture was separated by the use of a metal grate from the steel balls yielding a liquid toner concentrate of 7.25 percent solids wherein solids include resin, charge adjuvant, and pigment and 92.75 percent of NORPAR 15®. The particle diameter was 1.91 microns average by area as measured with a Horiba Cappa 500.

EXAMPLE V

BASE POLYMER PREPARATION 1

Sequential group transfer polymerization (GTP) of 2-ethylhexyl methacrylate (EHMA) and 2-dimethylaminoethyl methacrylate (DMAEMA) to prepare the AB diblock copolymer precursor, poly[2-ethylhexyl methacrylate (B block)-co-N,N-dimethylamino-N-ethyl methacrylate (A block)], of the quaternary ammonium zwitterionic was accomplished as follows. The quaternary ammonium zwitterionic AB diblock copolymer charge director or protonated ammonium AB diblock copolymer charge directors were prepared from the AB diblock base polymer (precursor), which is a 3×scale-up of the following procedure.

AB diblock copolymer precursors were prepared by a standard group transfer sequential polymerization procedure (GTP) wherein the ethylhexyl methacrylate monomer was first polymerized to completion and then the 2-dimethylaminoethyl methacrylate monomer was polymerized onto the living end of the ethylhexyl methacrylate polymer. All glassware was first baked out in an air convection oven at about 120° C. for about 16 to 18 hours.

A 2 liter 3-neck round bottom flask equipped with a magnetic stirring football, an Argon inlet and outlet, and a neutral alumina (150 grams) column (later to be replaced by a rubber septum and then a liquid dropping funnel) was charged through an alumina column, which is maintained under a positive Argon flow and sealed from the atmosphere, with 415 grams (2.093 mole) of freshly distilled 2-ethylhexyl methacrylate (EHMA) monomer. Subsequently, 500 milliliters of freshly distilled tetrahydrofuran solvent, distilled from sodium benzophenone, was rinsed through the same alumina column into the polymerization flask vessel. Subsequently, the GTP initiator, 26 milliliters of methyl trimethylsilyl dimethylketene acetal (22.31 grams; 0.1280 mole), was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.1 milliliter of a 0.66 molar solution of tetrabutylammonium acetate (catalyst) in the same dry tetrahydrofuran was syringed into the polymerization vessel. After an additional 1 hour of stirring under Argon, the polymerization temperature peaked at about 50° C. Shortly thereafter, 90 grams (0.572 mole) of freshly distilled 2-dimethylaminoethyl methacrylate (DMAEMA) monomer was dropwise added to the polymerization vessel: The polymerization solution was stirred under Argon for at least 4 hours after the temperature peaked. Then 5 milliliters of methanol were added to quench the live ends of the fully grown copolymer. The above charges of initiator and monomers provide an $M_n$ and average degree of polymerization (DP) for each block. For the EHMA nonpolar B block, the charged $M_n$ is 3,243 and the DP is 16.4 and for the DMAEMA polar A block, the charged $M_n$ is 703 and the DP is 4.5. $^1$H-NMR analysis of a 20 percent (g/dl) $CDCl_3$ solution of the copolymer indicated a 77 to 78 mole percent EHMA content and a 22 to 23 mole percent DMAEMA content. GPC analysis was obtained on a portion of the 1 to 2 gram sample of isolated polymer using three 250×8 millimeters PHENOMENEX PHENOGEL™ columns in series (100, 500, 1000 Angstroms) onto which was injected a 10 microliter sample of the block copolymer at 1 percent (weight/volume) in THF. The sample was eluted with THF at a flow rate of 1 milliliter/minute and the chromatogram was detected with a 254 nanometer UV detector. GPC analysis indicated the major peak at 14.5 to 19.9 counts, a polystyrene equivalent number average molecular weight of 3,912 and a weight average molecular weight of 6,222 (MWD of 1.59). Two barely discernible broad low molecular weight peaks were located at 20 to 25.1 and 25.1 to 30 counts.

A small (1 to 2 grams) portion of the AB diblock copolymer can be isolated for GPC and $^1$H-NMR analyses by precipitation into 10 times its solution volume of methanol using vigorous mechanical agitation. The precipitated copolymer was then washed on the funnel with more methanol and was then dried overnight in vacuo (about 0.5 Torr) at about 50° C.

The AB diblock copolymer prepared above was not isolated but instead was solvent exchanged to provide a copolymer solution in toluene. Typically, the methanol quenched copolymer solution in tetrahydrofuran was rotoevaporated at about 50° C. at reduced pressure (40 to 50 millimeters Hg) in a tared round bottom flask until no more solvent distilled over. Then toluene was added to the solid polymeric residue to provide a solution of the block copolymer at any desired solids level. In this Example, a 50 percent base polymer solution was prepared by adding about 527 grams of toluene to the solid polymer residue of about the same weight.

EXAMPLE VI

BASE POLYMER PREPARATION 2

An AB diblock copolymer precursor, poly[2-ethylhexyl methacrylate (B block)-co-N,N-dimethylamino-N-ethyl methacrylate (A block)], was prepared as described in Example V using the same polymerization procedure and conditions except the polymerization scale was increased by a factor of three. 1H-NMR analysis of a 17.5 percent (g/dl) $CDCl_3$ solution of an isolated portion of the AB diblock copolymer indicated about a 77 to 78 mole percent EHMA repeat unit content and a 22 to 23 mole percent DMAEMA repeat unit content. GPC analysis, as described in polymer preparation 1, indicated the major peak at 14.4 to 22.6 counts to have a polystrene equivalent number average molecular weight of 2,253 and a weight average molecular weight of 5,978 (MWD of 2.65). A broad low molecular weight peak was located at 24 to 32 counts. The AB diblock copolymer, poly[2-ethylhexyl methacrylate (B block)-co-N,N-dimethylamino-N-ethyl methacrylate (A block)], prepared in this Example was used to prepare the invention charge directors of Examples VIII, X, and XII.

EXAMPLE VII

BASE POLYMER PREPARATION 3

An ABA triblock copolymer was prepared by a standard group transfer polymerization (GTP) procedure wherein the 2-dimethylaminoethyl methacrylate monomer was first polymerized to completion and then the 2-ethylhexyl methacrylate monomer was polymerized onto the living end of the poly(2-dimethylaminoethyl methacrylate) block, and finally the second dimethylaminoethyl methacrylate monomer charge was polymerized onto the living end of the poly(2-dimethylaminoethyl methacrylate-co-2-ethylhexyl methacrylate) AB diblock copolymer to provide the-ABA triblock copolymer, poly[2 -ethylhexyl methacrylate (B block)-co-N,N-dimethylamino-N-ethyl methacrylate (A block)].

A 100 milliliter 3-neck round bottom flask (small reactor) equipped with a magnetic stirring football, an Argon inlet and outlet thru rubber septa, and a neutral alumina (50 grams) column was charged through the alumina column, which is maintained under a positive Argon flow and sealed from the atmosphere, with 45 grams (0.286 mole) of freshly distilled 2-dimethylaminoethyl methacrylate (EHMA) monomer. Then, 50 milliliters of freshly distilled tetrahydrofuran solvent, distilled from sodium benzophenone, was rinsed through the same alumina column into the polymerization vessel. Subsequently, the GTP initiator, 15 milliliters of methyl trimethylsilyl dimethylketene acetal (12.87 grams; 0.0738 mole), was syringed into the polymerization vessel. The acetal was originally vacuum distilled and a middle fraction was collected and stored (under Argon) for polymerization initiation purposes. After stirring for about 5 minutes at ambient temperature under a gentle Argon flow, 0.3 milliliter of a 0.033 molar solution of tetrabutylammonium acetate (catalyst) in the same dry tetrahydrofuran was syringed into the polymerization vessel. A mild exotherm ensued (as evidenced by the reaction vessel being warm to the touch) indicating that the polymerization was successfully initiated. Shortly thereafter (about 5 minutes) the exotherm peaked. About 10 minutes later, the contents of the small reactor were syringe transferred to a second 2 liter reactor (large reactor), equipped and conditioned like the small reactor, which large reactor contained 415 grams (2.093 mole) of freshly distilled 2-ethylhexyl methacrylate (EHMA) monomer which had been passed through a neutral alumina (150 grams) column that was rinsed with 500 milliliters of freshly distilled THF. After mixing the contents of the two reactors, 0.1 milliliter of a 0.033 molar solution of tetrabutylammonium acetate (catalyst) in the same dry tetrahydrofuran was syringed into the large reactor. A mild exotherm ensued indicating polymerization of the EHMA was successfully initiated by the living poly(2 -dimethylaminoethyl methacrylate). After the exotherm peaked, the contents of the large reactor were stirred for an hour and then an additional 45 grams (0.286 mole) of freshly distilled DMAEMA were charged to the reactor using the same procedure for the first DMAEMA charge. A mild exotherm ensued indicating polymerization of the second DMAEMA charge was successfully initiated by the living poly(2 -dimethylaminoethyl methacrylate-co-2-ethylhexyl methacrylate) diblock copolymer. The polymerization mixture was allowed to stir overnight (18 hours) at ambient temperature under Argon. After rotoevaporation of the THF at about 40° C. to 50° C. and 30 to 50 millimeters Hg, sufficient toluene solvent was added to the polymeric residue to provide about a 50 weight percent solution of the ABA triblock copolymer, poly(2-ethylhexyl methacrylate-co-N,N-dimethylamino-N-ethyl methacrylate). The above charges of initiator and monomers provide an $M_n$ and average degree of polymerization (DP) for each block. For the EHMA middle nonpolar B block, the charged $M_n$ is 5,623 and the DP is 28.4, and for the two DMAEMA end polar A blocks, the charged $M_n$ is 610 and the DP is 3.9. The total charged molecular weight ($M_n$) is 6,843. The overall charged composition is 21.5 mole percent (17.8 weight percent) DMAEMA repeat units and 78.5 mole percent (82.2 weight percent) EHMA repeat units. NMR and GPC analyses were carried out as in Example V. 1H-NMR analysis of the triblock copolymer indicated about 82.7 mole percent of EHMA (85.7 weight percent) and 17.4 mole percent of DMAEMA (14.3 weight percent). GPC analysis indicated the major peak to have a polystyrene equivalent number average molecular weight of 5,078 and a weight average molecular weight of 7,239 (MWD of 1.43). The ABA triblock copolymer, poly[2-ethylhexyl methacrylate (B block)-co-N,N-dimethylamino-N-ethyl methacrylate (A block)], prepared in this Example was used to prepare the charge directors of Examples IX, XI, and XIII.

EXAMPLE VIII

CHARGE DIRECTOR PREPARATION 1

Preparation of the hydrogen bromide ammonium salt AB diblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)] prepared in Example VI and aqueous hydrogen bromide.

To a 1 liter Erlenmeyer flask were added 294.93 grams of a 50.86 weight percent toluene solution of an AB diblock copolymer (150 grams) obtained from poly(2-ethylhexyl methacrylate-co-N,N-dimethylamino-N-ethyl methacrylate) prepared in Example VI comprised of 18.23 weight percent of 2-dimethylaminoethyl methacrylate (DMAEMA) repeat units and 81.77 weight percent of 2-ethylhexyl methacrylate (EHMA) repeat units. The 150 grams of AB diblock copolymer contains 27.35 grams (0.174 mole) of DMAEMA repeat units. To this magnetically stirred AB diblock copolymer toluene solution at about 20° C. were added 28.73 grams (0.170 mole of HBr) of 48 percent aqueous hydrobromic acid (Aldrich). A 2° C. exotherm was observed in the first 5 minutes, but after the addition of 23.4 grams of methanol, an 8° C. exotherm was observed in the next five minutes and then the temperature of the contents of the reaction vessel slowly began to drop. To reduce the viscosity of the reaction mixture, 150 grams of additional toluene were added to provide a 33 weight percent solids solution of moderate viscosity. This solution was magnetically stirred for 20 hours at ambient temperature and was then diluted with NORPAR 15® (2,850 grams) to provide a 5 weight percent (based on the corresponding starting weight of the AB diblock copolymer from Example VI) charge director solution after toluene and methanol rotoevaporation. Toluene and methanol were rotoevaporated at 50° to 60° C. for 1 to 2 hours at 40 to 50 millimeters Hg from 500 to 600 milliliter portions of the charge director solution until the entire sample was rotoevaporated. The 5 weight percent NORPAR 15® solution of poly(2-ethylhexyl methacrylate-co-N,N-dimethyl-N-ethyl methacrylate ammonium bromide) had a conductivity of 1,700 to 1,735 pmhos/centimeter and was used to charge liquid toner.

EXAMPLE IX

CHARGE DIRECTOR PREPARATION 2

Preparation of the hydrogen bromide ammonium salt ABA triblock copolymer charge director, poly[2-ethylhexyl methacrylate (B block)-co-N,N-dimethyl-N-ethyl methacrylate ammonium bromide (A block)], from poly[2-ethylhexyl methacrylate (B block)-co-N,N-dimethylamino-N-ethyl methacrylate (A block)] prepared in Example VII and aqueous hydrogen bromide.

To a 250 milliliter single neck round bottom flask containing a magnetic stirring football were added 50 grams of a 50.07 weight percent toluene solution of an ABA triblock copolymer (25.04 grams) from poly(2 -ethylhexyl methacrylate-co-N,N-dimethylamino-N-ethyl methacrylate) prepared in Example VII comprised of 13.90 weight percent of 2-dimethylaminoethyl methacrylate (DMAEMA) repeat units and 86.10 weight percent of 2-ethylhexyl methacrylate (EHMA) repeat units. The 25.04 grams of ABA triblock copolymer contains 3.48 grams (0.0221 mole) of DMAEMA repeat units. To this magnetically stirred ABA triblock copolymer toluene solution at about 20° C. were added 3.66 grams (0.0217 mole of HBr) of 48 percent aqueous hydrobromic acid (Aldrich) which targets 98 mole percent of the N,N-dimethylamino-N-ethyl methacrylate repeat units present in Base Polymer 3 from Example VII. The aqueous HBr solution was rinsed into the flask with 2.98 grams of methanol to provide about a 33 percent solids level of the ABA triblock copolymer poly(2 -ethylhexyl methacrylate-co-N,N-dimethyl-N-ethyl methacrylate ammonium bromide). This solution was magnetically stirred for 19.5 hours at ambient temperature and was then diluted with NORPAR 15® (475.67 grams) to provide a 5 weight percent (based on the corresponding starting weight of the ABA triblock copolymer from Example VII) charge director solution, after rotoevaporation of the toluene and methanol. The toluene and methanol were rotoevaporated at 50° to 60° C. for 1 to 2 hours at 30 to 40 millimeters Hg. The 5 weight percent NORPAR 15® solution of the ABA triblock copolymer, poly(2-ethylhexyl methacrylate-co-N,N-dimethyl-N-ethyl methacrylate ammonium bromide), had a conductivity of 1,346 pmhos/centimeters and was used to charge liquid toner.

EXAMPLE X

CHARGE DIRECTOR PREPARATION 3

Preparation of the AB diblock carboxylate zwitter ion copolymer charge director, poly[2-ethylhexyl methacrylate (B block)-co-N,N-dimethyl-N-methylenecarboxylate-N-ammoniumethyl methacrylate (A block)] from poly[2-ethylhexyl methacrylate (B block)-co-N,N-dimethylamino-N-ethyl methacrylate (A block)] prepared in Example VI and sodium iodoacetate.

A 100 milliliter round bottom flask equipped with a magnetic stirring football and a water condenser was charged with 50 grams of a 50.86 weight percent toluene solution of Base Polymer 2 from Example VI. The toluene solution contains 25.43 grams of Base Polymer 2 which contains about 4.64 grams (0.0295 mole) of 2-dimethylaminoethyl methacrylate (DMAEMA) repeat units. To this solution were added 5.95 grams (0.0286 mole) of sodium iodoacetate (Aldrich) which targets 97 mole percent of the DMAEMA repeat units present in Base Polymer 2. About 10 milliliters of methanol, 2 milliliters of water, and an additional 10 milliliters of toluene were added to the reactor to give a turbid mixture at ambient conditions. The turbid mixture was magnetically stirred at 60° to 65° C. for 18.5 hours to give a clear solution at elevated temperature. After cooling to ambient temperature, a slightly hazy, yellow solution remained which was rotoevaporated at 65° to 70° C. for 1.5 to 2.0 hours at 40 to 60 millimeters Hg. The solid residue was next extracted with 200 milliliters of deionized water for 2 hours and the mixture was filtered through cheese cloth and the filtered coarse particle solid was slurried in 350 milliliters of deionized water for 18 hours at ambient temperature to further help to remove the sodium iodide by product. After the solid settled gravimetrically, the supernate emulsion was decanted off and the solid residue was briefly slurried with 50 milliliters ethanol. The mixture was filtered and the solid was washed on the filter with 2×50 milliliter portions of ethanol and was then dried in vacuo (about 0.3 millimeter Hg for 18.5 hours at 50° to 60° C.) to give 8.6 grams (31.7 percent recovered yield) of poly[2-ethylhexyl methacrylate-co-N,N-dimethyl-N-methylenecarboxylate-N-ammoniummethyl methacrylate] as the solid carboxylate zwitter ion copolymer charge director. The $^1$H-NMR analysis of the solid was missing the proton signal (6H at 2.23 ppm) of the gem dimethyl group on the unquaternized nitrogen of the precursor polymer prepared in Example VI indicating that quaternization by the sodium iodoacetate was complete in the isolated sample. Polymer chains with incompletely quaternized DMAEMA repeat units are substantially soluble in the ethanol and are thereby extracted from the isolated sample.

To 3 grams of solid poly(2-ethylhexyl methacrylate-co-N,N-dimethyl-N-methylenecarboxylate-N-ammoniumethyl methacrylate), which is equivalent to 2.82 grams of the polymer prepared in Example VI, were added 53.58 grams of NORPAR 15® in an attempt to prepare a 5 percent charge director solution but an oily insoluble residue remained. Dilution of half of the 5 percent solution to a 1 percent charge director solution failed to significantly increase the solubility of the oily residue. To the other half of the 5 percent charge director solution were added about 15 milliliters of methanol to give an opaque emulsion which was rotoevaporated at 50° to 60° C. for about 0.25 to 0.50 hour at 40 to 60 millimeters Hg to remove the loosely bound methanol. The resulting charge director, poly(2-ethylhexyl methacrylate-co-N,N-dimethyl-N-methylenecarboxylate-N-ammoniumethyl methacrylate), was now soluble in NORPAR 15® at 5 weight percent (based on the corresponding starting weight of the AB diblock base polymer from Example VI). This NORPAR 15® charge director solution had a conductivity of 1,225 pmhos/centimeters and was used to charge liquid toners.

EXAMPLE XI

CHARGE DIRECTOR PREPARATION 4

Preparation of the ABA triblock carboxylate zwitter ion copolymer charge director, poly[2-ethylhexyl methacrylate (B block)-co-N,N-dimethyl-N-methylenecarboxylate-N-ammoniumethyl methacrylate (A block)] from poly [2-ethylhexyl methacrylate (B block)-co-N,N-dimethylamino-N-ethyl methacrylate (A block)] prepared in Example VII and sodium iodoacetate.

A 100 milliliter round bottom flask equipped with a magnetic stirring football and a water condenser was charged with 50 grams of a 50.07 weight percent toluene solution of Base Polymer 3 from Example VII. The toluene solution contains 25.04 grams of Base Polymer 3 which contains about 3.48 grams (0.0221 mole) of 2-dimethylaminoethyl methacrylate (DMAEMA) repeat units. To this solution were added 4.46 grams (0.0215 mole) of sodium iodoacetate (Aldrich) which targets 97 mole percent of the DMAEMA repeat units present in Base Polymer 3. Next, 15 milliliters of N,N-dimethylformamide (DM F) and 10 milliliters of methanol were added to the toluene dispersion. After about 2 hours heating at 60° to 65° C., a clear solution remained which was further heated for 18 hours at 60° to 65° C. After ambient cooling to room temperature, the solution became slightly hazy and was rotoevaporated for 2 hours at 60° to 70° C. (40 to 60 millimeters Hg) to remove the bulk of the solvents. Most of the residual DMF was removed by first redissolving the paste in 250 milliliters of toluene and then rotoevaporating to dryness over 1.0 to 1.5 hours at the above conditions. The solid mixture of the ABA triblock carboxylate zwitter ion copolymer charge director, poly[2-ethylhexyl methacrylate-co-N,N-dimethyl-N-methylenecarboxylate-N-ammoniumethyl methacrylate], and the sodium iodide by product amounted to 30.1 grams (theory 29.5 grams) indicating about 0.6 gram of DMF still remains. The remaining amount of DMF and sodium iodide was extracted by slurrying the solid mixture in 200 milliliters of deionized water at ambient temperature. The slurry was filtered throught cheese cloth and the recovered solid was slurried a second time in 300 milliliters of deionized water for 18 hours at ambient temperature. After allowing the solid to settle, the turbid supernate was decanted and the residual paste was filtered on a coarse frit funnel and was dried in vacuo (about 0.3 millimeter Hg at 50° to 60° C. for about 2.5 hours) to give a 65 percent recovered yield of the solid carboxylate zwitter ion copolymer charge director, poly[2-ethylhexyl methacrylate-co-N,N-dimethyl-N-methylenecarboxylate-N-ammoniumethyl methacrylate]. The $^1$H-NMR analysis of the solid was missing the proton signal (6H at 2.23 ppm) of the gem dimethyl group on the unquaternized nitrogen of the precursor polymer prepared in Example VII indicating that quaternization by the sodium iodoacetate was complete in the isolated sample product.

To 3.00 grams of solid poly(2-ethylhexyl methacrylate-co-N,N-dimethyl-N-methylenecarboxylate-N-ammoniumethyl methacrylate), which is equivalent to 2.86 grams of the polymer prepared in Example VII, were added 54.34 grams of NORPAR 15® in an attempt to prepare a 5 percent charge director solution, but an oily insoluble residue remained. Dilution of half of the 5 percent solution to a 1 percent charge director solution failed to significantly increase the solubility of the oily residue. To the other half of the 5 percent charge director solution were added about 15 milliliters of methanol to provide an opaque emulsion which was rotoevaporated at 50° to 60° C. for about 0.25 to 0.50 hour at 40 to 60 millimeter Hg to remove the loosely bound methanol. After repeating this methanol treatment a second time, the resulting 5 weight percent (based on the corresponding starting weight of the ABA triblock base polymer from Example VII) of NORPAR 15® charge director solution was cloudy but a separated insoluble phase refused to settle out. This charge director, poly(2-ethylhexyl methacrylate-co-N,N-dimethyl-N-methylenecarboxylate-N-ammoniumethyl methacrylate), solution in NORPAR 15® had a conductivity of 2,190 pmhos/centimeter and was used to charge liquid toners.

EXAMPLE XII

CHARGE DIRECTOR PREPARATION 5

Preparation of the AB diblock sulfonate zwitter ion charge director, poly[2-ethylhexyl methacrylate (B block)-co-N,N-dimethyl-N-propylenesulfonate-N-ammoniumethyl methacrylate (A block)] from poly(2-ethylhexyl methacrylate-co-N,N-dimethylamino-N-ethyl methacrylate) prepared in Example VII, and 1,3-propanesulfone.

A three-neck 500 milliliter round bottom flask, equipped with a thermometer, a magnetic stirring football, an Argon inlet, and a water condenser with Argon outlet to a mineral oil bubbler to maintain a gentle positive flow of Argon over the contents of the reaction vessel, was charged with 39.32 grams of the polymer solution (50.86 weight percent in toluene) from Base Polymer Preparation 2 in Example VI. The toluene solution contained 20.00 grams of Base Polymer 2 which contained 3.65 grams (0.0232 mole) DMAEMA repeat units as determined from $^1$H-NMR analysis. To the polymer solution with stirring at ambient temperature were added 2.68 grams (0.0220 mole) of 1,3-propanesulfone (Aldrich) and 48.8 grams of toluene to bring the total reactants concentration to 25 weight percent. The charged stoichiometry targets 95 mole percent of the DMAEMA repeat units for conversion to the corresponding propylenesulfonate zwitter ion. The polymer solution was stirred under a gentle flow of Argon for 21.5 hours at 66° to 77° C. in a temperature controlled silicone oil bath to give a solid mass which readily dissolved in 400 milliliters of toluene after brief stirring at ambient temperature. The polymer solution was next extracted with 100 milliliters of 1N aqueous NaOH solution and the toluene layer was separated and washed 2 times with 125 milliliter portions of deionized water. The separated wet toluene layer was rotoevaporated (40 to 50 millimeters Hg at 50° to 55° C. for about 0.5 hour) to azeotropically remove the water and to isolate the solid charge director which was then dried at 50° to 60° C. for 16.5 hours in vacuo at about 0.3 millimeter Hg. The sulfone modified solid charge director polymer weighed 17.9 grams (79 percent of theory). To 1.4 grams of this solid charge director were added 2.4 grams of toluene, 0.1 gram of deionized water, and 0.2 gram of methanol, and the mixture was stirred at ambient temperature for about 18 hours. NORPAR 15® (23.4 grams) was added to the charge director mixture and the cloudy solution was rotoevaporated at 55° to 60° C. for about 0.5 hour at 40 to 50 millimeters Hg to provide a 5 weight percent (based on the corresponding starting weight of the AB diblock base polymer from Example VI) cloudy NORPAR 15® solution after rotoevaporation of the toluene, methanol and water. This NORPAR 15® charge director solution was used to charge liquid toners.

EXAMPLE XIII

CHARGE DIRECTOR PREPARATION 6

Preparation of the ABA triblock sulfonate zwitter ion charge director, poly[2-ethylhexyl methacrylate (B block)-co-N,N-dimethyl-N-propylenesulfonate-N-ammoniumethyl methacrylate (A block)] from poly(2-ethylhexyl methacrylate-co-N,N-dimethylamino-N-ethyl methacrylate) prepared in Example VII, and 1,3-propanesulfone.

A three-neck 500 milliliter round bottom flask equipped with a thermometer, a magnetic stirring football, an Argon inlet, and a water condenser with Argon outlet to a mineral oil bubbler to maintain a gentle positive flow of Argon over the contents of the reaction vessel was charged with 39.94 grams of the polymer solution (50.07 weight percent in toluene) from Base Polymer Preparation 3 in Example VII. The toluene solution contained 20.00 grams of Base Polymer 3, which contained 2.78 grams (0.0177 mole) DMAEMA repeat units as determined from $^1$H-NMR analysis. To the polymer solution with stirring at ambient temperature were added 2.05 grams (0.0168 mole) of 1,3-propanesulfone (Aldrich) and 46.2 grams of toluene to bring the total reactants concentration to 25 weight percent. The charged stoichiometry targets 95 mole percent of the DMAEMA repeat units for conversion to the corresponding propylenesulfonate zwitter ion. The polymer solution was stirred under a gentle flow of Argon for 23 hours at 71° to 73° C. in a temperature controlled silicone oil bath to give a toluene solution having about the same viscosity as prior to the heating period. After dilution of the polymer solution with 200 milliliters more of toluene, it was next extracted with 100 milliliters of 1N aqueous NaOH solution and the toluene layer was separated and washed 2 times with 125 milliliter portions of deionized water. The separated wet toluene layer was rotoevaporated (40 to 50 millimeters Hg at 50° to 55° C. for about 0.75 hour) to azeotropically remove the water and to isolate the solid charge director which was then dried at 50° to 60° C. for 16.5 hours in vacuo at about 0.3 millimeter Hg. The sulfone modified solid charge director polymer weighed 17.45 grams (79 percent of theory). To 0.70 gram of this solid charge director were added 1.24 grams of toluene, 0.06 gram of deionized water, and 0.10 gram of methanol, and the mixture was stirred at ambient temperature for about 18 hours. NORPAR 15® (12.0 grams) was added to the charge director mixture and the clear solution was rotoevaporated at 55° to 60° C. for about 0.5 hour at 40 to 50 millimeters Hg to provide a 5 weight percent (based on the corresponding starting weight of the AB diblock base polymer from Example VI) clear NORPAR 15® solution after rotoevaporation of the toluene, methanol and water. This NORPAR 15® charge director solution was used to charge liquid toners.

CONTROL 1

MAGENTA LIQUID DEVELOPERS CHARGED WITH AB DIBLOCK AMMONIUM BROMIDE SALT COPOLYMER CHARGE DIRECTORS

Magenta liquid-toner dispersions were prepared by selecting 27.89 grams of liquid toner concentrate (7.17 percent solids in NORPAR 15®) from Example II and adding to it sufficient NORPAR 15® and 5 percent AB diblock charge director, poly[2-ethylhexyl methacrylate (B block)-co-N,N,N-trimethyl-N-ethyl methacrylate ammonium bromide (A block)], from Example VIII to provide 1 percent solids wherein solids include resin, charge adjuvant, and magenta pigment liquid toner dispersions containing 30, 50, 70, and 90 milligrams or 3, 5, 7 and 9 percent of charge director per gram of toner solids (Controls 1A to 1D). The 5 percent AB diblock charge director was prepared from Base Polymer Preparation 2 in Example VI. After 2, 9, 34 and 114 days of equilibration, mobility and conductivity were measured for these 1 percent liquid toners to determine the toner charging rate and level. These values were compared to mobility and conductivity values obtained for the 1 percent magenta liquid toners described in Example XIV containing the same concentrations of ABA multiple block charge director after similar equilibration time periods. Table 1 in Example XIV contains 200 gram formulations for both sets of magenta liquid toners or developers charged with the AB diblock and ABA multiple block copolymer charge directors. Table 2 in Example XIV contains the corresponding mobility and conductivity values for both sets of magenta liquid toners or developers.

EXAMPLE XIV

MAGENTA LIQUID DEVELOPERS CHARGED WITH ABA MULTIPLE BLOCK AMMONIUM BROMIDE SALT COPOLYMER CHARGE DIRECTORS

Magenta liquid toner dispersions were prepared by utilizing 27.89 grams of liquid toner concentrate (7.17 percent solids in NORPAR 15®) from Example II and adding to it sufficient NORPAR 15® and 5 percent ABA multiple block charge director, poly[2-ethylhexyl methacrylate (B block)-co-N,N,N-trimethyl-N-ethyl methacrylate ammonium bromide (A block)], from Example IX to provide 1 percent solids wherein solids include resin, charge adjuvant, and pigment liquid toner dispersions containing 30, 50, 70, and 90 milligrams or 3, 5, 7, and 9 percent charge director per gram of toner solids (Examples XIVA to XIVD). The 5 percent ABA multiple block charge director was prepared from Base Polymer Preparation 3 in Example VII. After 2, 9, 30 and 126 days of equilibration, mobility and conductivity were measured for these 1 percent liquid toners to determine the toner charging rate and level. These values were compared to mobility and conductivity values obtained for the 1 percent magenta liquid toners described in Control 1 containing the same concentrations of AB diblock charge director after similar equilibration time periods. Table 1 contains 200 gram formulations for both sets of magenta developers charged with the AB diblock and ABA multiple block copolymer charge directors. Table 2 contains-the corresponding mobility and conductivity values for both sets of magenta liquid toners or developers.

TABLE 1

MAGENTA LIQUID DEVELOPER FORMULATIONS CHARGED WITH AB DIBLOCK AND ABA TRIBLOCK AMMONIUM BROMIDE SALT COPOLYMER CHARGE DIRECTORS

| Developer ID: Control or Example No. | Grams Toner Concentrate From Example II | Grams Added NORPAR 15 ® | Grams Added 5% Charge Director (CD) in NORPAR 15 ® | CD Preparation Example No. and CD Level in mg CD/g Toner Solids |
|---|---|---|---|---|
| Control 1A | 27.89 | 170.91 | 1.20 | Example VIII: 30/1 AB |
| Example XIVA | | | | Example IX: 30/1 ABA |
| Control 1B | 27.89 | 170.11 | 2.00 | Example VIII: 50/1 AB |
| Example XIVB | | | | Example IX: 50/1 ABA |
| Control 1C | 27.89 | 169.31 | 2.80 | Example VIII: 70/1 AB |
| Example XIVC | | | | Example IX: 70/1 ABA |
| Control 1D | 27.89 | 168.51 | 3.60 | Example VIII: 90/1 AB |
| Example XIVD | | | | Example IX: 90/1 ABA |

A review of the tables, Table 2 follows, reveals that magenta developers charged with the ABA multiple block ammonium bromide salt copolymer charge directors (Examples XIVA to D) provided higher mobilities than the corresponding magenta developers charged with the AB diblock ammonium bromide salt copolymer charge directors (Controls 1A to D) at any common charge director level after aging for a comparable time period. A comparison of Example XIVB and Control 1C developers after a prolonged aging period (114 or 126 days) charged to about the same mobility level indicates that the ABA multiple block copolymer charged developer in Example XIVB has one half the conductivity of the AB diblock copolymer charged developer in Control 1C. It is believed that this conductivity advantage primarily occurs because less ABA multiple block copolymer charge director is used in the Example XIVB developer than AB diblock copolymer charge director in the Control 1C developer. Thus, the multiple block (ABA) copolymer charge director is not only more cost effective, that is about 71 percent of the cost of the corresponding AB diblock copolymer charge director of the same molecular weight based on the lesser amount (50 milligrams versus 70 milligrams) required to obtain at least the same charging level, but also provides developers with lower conductivity levels which is important in generating better image quality such as improved print density, improved resolution and less background. Therefore, the ABA multiple block ammonium bromide copolymer charge directors are advantageous over the corresponding AB diblock ammonium bromide copolymer charge directors since the ABA multiple block copolymer charge directors provided more rapid charging and generally higher charging levels than the corresponding AB diblock copolymer charge directors when magenta developers were charged at the same charge director level, and since less ABA multiple block copolymer charge director was required to obtain an acceptable (charging) mobility level, lower conductivity levels can also be obtained for developers charged with ABA multiple block ammonium bromide copolymer.

TABLE 2

MOBILITY AND CONDUCTIVITY RESULTS FOR MAGENTA LIQUID DEVELOPERS CHARGED WITH AB DIBLOCK AND ABA TRIBLOCK AMMONIUM BROMIDE SALT COPOLYMER CHARGE DIRECTORS

| Developer ID: Control or Example No. | Aging Time in Days | CD Level: mg CD/g Toner Solids | Mobility $E^{-10}m^2/Vs$ | Cond. pmho/cm | Comments |
|---|---|---|---|---|---|
| Control IA | 2 | 30/1 | −0.23 | 1 | Very Low |
| | 9 | AB | −0.36 | 1 | Charging and Low |
| | 34 | Diblock | −0.26 | 1 | Conductivity |
| | 114 | Copolymer | −0.17 | 1 | |
| Example | 2 | 30/1 | −1.10 | 2 | Low Charging and |
| XIVA | 9 | ABA | −1.21 | 2 | Low Conductivity |
| | 30 | Triblock | −0.60 | 2 | |
| | 126 | Copolymer | −0.28 | 1 | |
| Control IB | 2 | 50/1 | −1.39 | 6 | Intermediate |
| | 9 | AB | −1.89 | 5 | Charging and Low |
| | 34 | Diblock | −1.98 | 6 | Conductivity |
| | 114 | Copolymer | −1.89 | 5 | |
| Example | 2 | 50/1 | −2.06 | 8 | High Charging and |
| XIVB | 9 | ABA | −2.39 | 8 | Medium |
| | 30 | Triblock | −2.29 | 7 | Conductivity |
| | 126 | Copolymer | −2.50 | 6 | |
| Control IC | 2 | 70/1 | −1.53 | 12 | High Charging and |
| | 9 | AB | −2.00 | 11 | Medium |
| | 34 | Diblock | −2.06 | 13 | Conductivity |
| | 114 | Copolymer | −2.52 | 12 | |
| Example | 2 | 70/1 | −2.14 | 14 | High Charging and |
| XIVC | 9 | ABA | −2.29 | 14 | High Conductivity |
| | 30 | Triblock | −2.28 | 14 | |
| | 126 | opolymer | −2.66 | 13 | |
| Control ID | 2 | 90/1 | −1.55 | 19 | Intermediate to |
| | 9 | AB | −1.75 | 18 | High Charging and |
| | 34 | Diblock | −1.83 | 20 | High Conductivity |
| | 114 | Copolymer | −2.33 | 20 | |
| Example | 2 | 90/1 | −1.95 | 21 | High Charging and |
| XIVD | 9 | ABA | −2.21 | 21 | High Conductivity |
| | 30 | Triblock | −2.15 | 22 | |
| | 126 | Copolymer | −2.55 | 21 | |

Figure 1:
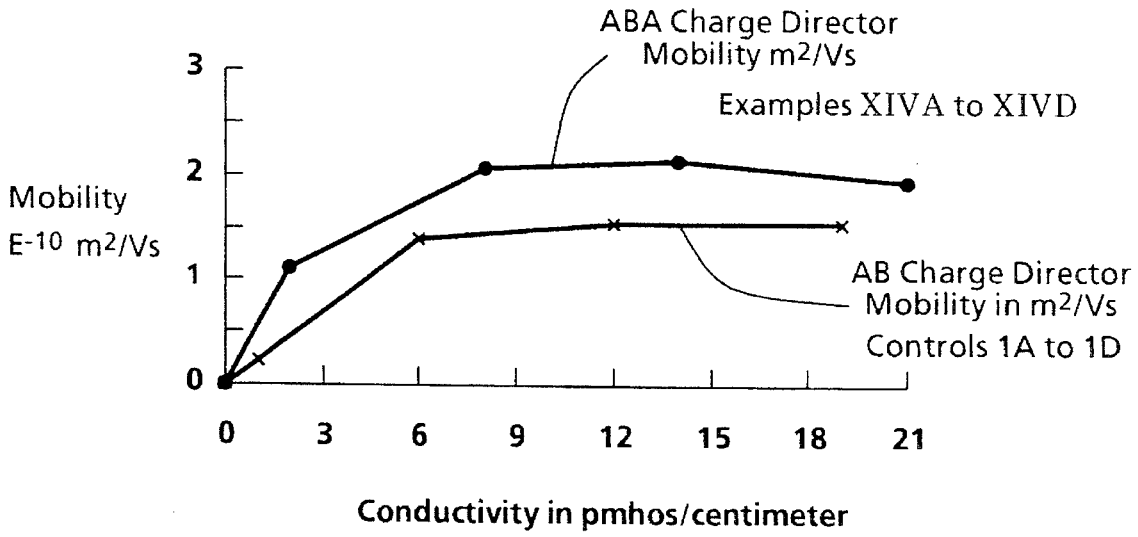
Figure 2:
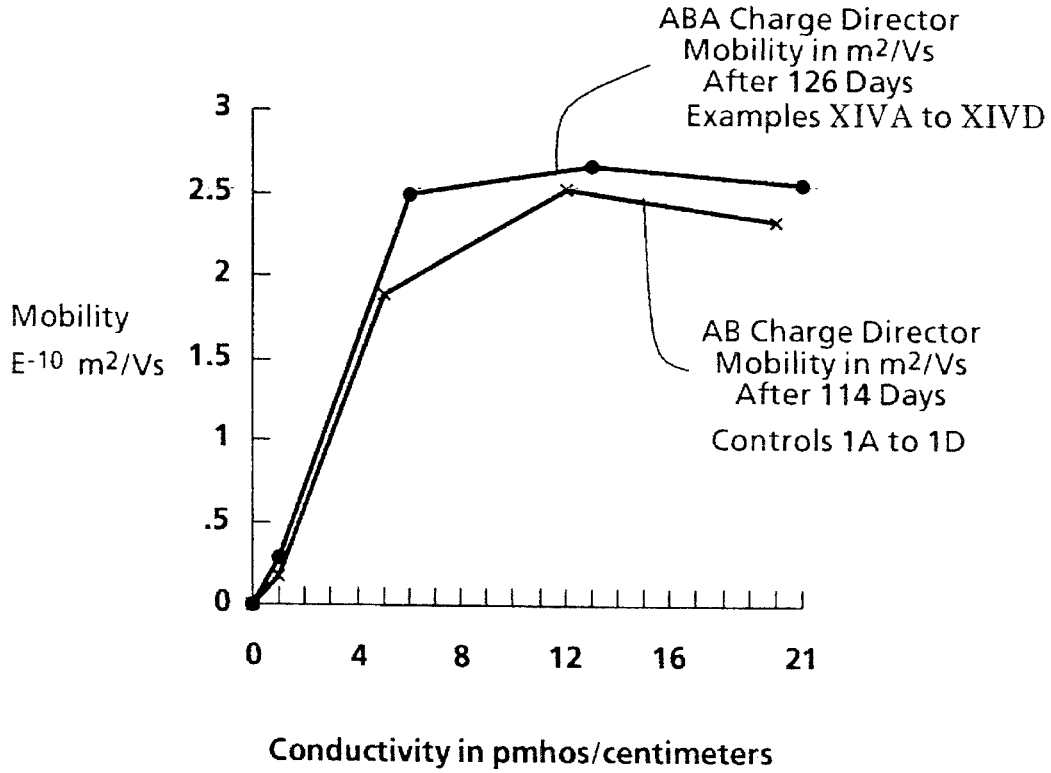

FIG. 1 illustrates the consistently higher mobilities obtained after 2 days for magenta developers prepared from the magenta liquid toner concentrate of Example II charged with the ABA multiple block ammonium bromide salt copolymer charge director of the present invention, Example IX, versus the same magenta developers but charged with the corresponding AB diblock ammonium bromide salt copolymer charge director of Example VIII. FIG. 2 illustrates the same trend for the same magenta developers after 114 or 126 days indicating that the charging advantage obtained for the ABA block ammonium bromide salt copolymer charge director was maintained for a prolonged time period.

CONTROL 2

CYAN LIQUID DEVELOPERS CHARGED WITH AB DIBLOCK AMMONIUM BROMIDE SALT COPOLYMER CHARGE DIRECTORS

Cyan liquid toner dispersions were prepared by selecting 28.05 grams of liquid toner concentrate (7.13 percent solids in NORPAR 15®) from Example I and adding to it sufficient NORPAR 15® and 5 percent AB diblock charge director, poly[2-ethylhexyl methacrylate (B block)-co-N,N,N-trimethyl-N-ethyl methacrylate ammonium bromide (A block)], from Example VIII to provide 1 percent solids liquid developers wherein solids include resin, charge adjuvant, and pigment containing 30, 50, 70, and 90 milligrams or 3, 5, 7 and 9 percent charge director per gram of toner solids (Controls 2A to 2D). The 5 percent AB diblock charge director was prepared from Base Polymer Preparation 2 of Example VI. After 2, 9, 34 and 114 days of equilibration, mobility and conductivity were measured for these 1 percent liquid toners to determine the toner charging rate and level.

These values were compared to mobility and conductivity values obtained for the 1 percent cyan (PV FAST BLUE™) liquid toners described in Example XV containing the same concentrations of ABA multiple block charge director after similar equilibration time periods. Table 3 in Example XV contains 200 gram formulations for both sets of cyan developers charged with AB diblock and ABA multiple block copolymer charge directors. Table 4 in Example XV contains the corresponding mobility and conductivity values for both sets of cyan liquid toners or developers.

EXAMPLE XV

CYAN LIQUID DEVELOPERS CHARGED WITH ABA MULTIPLE BLOCK AMMONIUM BROMIDE SALT COPOLYMER CHARGE DIRECTORS

Cyan liquid toner dispersions were prepared by selecting 28.05 grams of liquid toner concentrate (7.13 percent solids in NORPAR 15®) from Example I and adding to it sufficient NORPAR 15® and 5 percent ABA multiple block charge director, poly[2-ethylhexyl methacrylate (B block)-co-N,N, N-trimethyl-N-ethyl methacrylate ammonium bromide (A block)], of Example IX to provide 1 percent solids liquid toner dispersions wherein solids include resin, charge adjuvant, and pigment containing 30, 50, 70, and 90 milligrams or 3, 5, 7, and 9 percent charge director per gram of toner solids (Examples XVA to XVD). The 5 percent ABA multiple block charge director was prepared from Base Polymer Preparation 3 in Example VII. After 2, 9, 30 and 126 days of equilibration, mobility and conductivity were measured for these 1 percent liquid toners to determine the toner charging rate and level.

These values were compared to mobility and conductivity values obtained for the 1 percent cyan liquid toners described in Control 2 containing the same concentrations of AB diblock charge director after similar equilibration time periods. Table 3 contains 200 gram formulations for both sets of cyan liquid developers charged with the AB diblock and ABA multiple block copolymer charge directors. Table 4 contains the corresponding mobility and conductivity values for both sets of cyan liquid toners or developers.

Inspection of Table 4 reveals that cyan developers charged with the ABA multiple block ammonium bromide salt copolymer charge director (Examples XVA to D) consistently provided higher mobilities than the corresponding cyan developers charged with the AB diblock ammonium bromide salt copolymer charge directors (Controls 2A to D) at any charge director level shown after aging for a comparable time period. A comparison of Example XVA developer aged for 9 or 30 days and Control 2B developer aged for 114 days indicates that about the same mobility level was achieved for each developer, however, the ABA multiple block copolymer charged developer in Example XVA has only two-thirds the conductivity of the AB diblock copolymer charged developer in Control 2B. This conductivity advantage occurs primarily because it is believed that less ABA multiple block copolymer charge director was used in the Example XVA developer than AB diblock copolymer charge director in the Control 2B developer. Thus, the multiple block (ABA) copolymer charge director is not only more cost effective but also provides satisfactory developers with lower conductivity levels which is important in generating improved higher image quality. Therefore, ABA multiple block ammonium bromide salt copolymer charge directors are advantageous as compared to the corresponding AB diblock ammonium bromide salt copolymer charge directors primarily since ABA multiple block copolymer charge directors provide more rapid charging and generally higher charging levels than the corresponding AB diblock copolymer charge directors when cyan developers are charged at the same charge director level, and primarily because less ABA triblock copolymer charge director was required to obtain an acceptable (charging) mobility level, lower conductivity levels can also be obtained for developers charged with the ABA multiple block ammonium bromide salt copolymer.

TABLE 3

CYAN LIQUID DEVELOPER FORMULATIONS CHARGED WITH AB DIBLOCK AND ABA MULTIPLE BLOCK AMMONIUM BROMIDE SALT COPOLYMER CHARGE DIRECTORS

MAGENTA LIQUID DEVELOPER FORMULATIONS CHARGED WITH AB DIBLOCK AND ABA TRIBLOCK AMMONIUM BROMIDE SALT COPOLYMER CHARGE DIRECTORS

| Developer ID: Control or Example No. | Grams Toner Concentrate From Example II | Grams Added NORPAR 15 ® | Grams Added 5% Charge Director (CD) in NORPAR 15 ® | CD Preparation Example No. and CD Level in mg CD/g Toner Solids |
|---|---|---|---|---|
| Control 2A Example XVA | 28.05 | 170.75 | 1.20 | Example VIII: 30/1 AB Example IX: 30/1 ABA |
| Control 2B Example XVB | 28.05 | 169.95 | 2.00 | Example VIII: 50/1 AB Example IX: 50/1 ABA |
| Control 2C Example XVC | 28.05 | 169.15 | 2.80 | Example VIII: 70/1 AB Example IX: 70/1 ABA |
| Control 2D Example XVD | 28.05 | 168.35 | 3.60 | Example VIII: 90/1 AB Example IX: 90/1 ABA |

TABLE 4

MOBILITY AND CONDUCTIVITY RESULTS FOR CYAN LIQUID DEVELOPERS CHARGED WITH AB DIBLOCK AND ABA TRIBLOCK AMMONIUM BROMIDE COPOLYMER CHARGE DIRECTORS

| Developer ID: Control or Example No. | Aging Time in Days | CD Level: mg CD/ g Toner Solids | Mobility $E^{-10}m^2/Vs$ | Cond. pmho/ cm | Commments |
|---|---|---|---|---|---|
| Control 2A | 2 | 30/1 | −1.44 | 8 | Intermediate to |
| | 9 | AB | −1.85 | 8 | High Charging and |
| | 34 | Diblock | −1.86 | 8 | Medium Conductivity |
| | 114 | Copolymer | −2.08 | 8 | |
| Example | 2 | 30/1 | −1.85 | 10 | Intermediate to |
| XVA | 9 | ABA | −2.14 | 9 | High Charging and |
| | 30 | Triblock | −2.16 | 11 | Medium Conductivity |
| | 126 | Copolymer | −2.29 | 9 | |
| Control 2B | 2 | 50/1 | −1.60 | 15 | Intermediate to |
| | 9 | AB | −1.72 | 14 | High Charging and |
| | 34 | Diblock | −2.03 | 16 | High Conductivity |
| | 114 | Copolymer | −2.15 | 15 | |
| Example | 2 | 50/1 | −1.97 | 15 | Intermediate to |
| XVB | 9 | ABA | −2.06 | 15 | High Charging and |
| | 30 | Triblock | −2.05 | 17 | High Conductivity |
| | 126 | Copolymer | −2.36 | 16 | |
| Control 2C | 2 | 70/1 | −1.37 | 21 | Intermediate |
| | 9 | AB | −1.56 | 20 | Charging and |
| | 34 | Diblock | −1.71 | 23 | High Conductivity |
| | 114 | Copolymer | −2.01 | 23 | |
| Example | 2 | 70/1 | −1.87 | 22 | Intermediate to |
| XVC | 9 | ABA | −1.98 | 22 | High Charging and |
| | 30 | Triblock | −1.98 | 24 | High Conductivity |
| | 126 | Copolymer | −2.26 | 25 | |
| Control 2D | 2 | 90/1 | −1.30 | 28 | Intermediate |
| | 9 | AB | −1.64 | 26 | Charging and |
| | 34 | Diblock | −1.65 | 29 | High Conductivity |
| | 114 | Copolymer | −2.02 | 30 | |
| Example | 2 | 90/1 | −1.85 | 27 | Intermediate to |
| XVD | 9 | ABA | −1.98 | 28 | High Charging and |
| | 30 | Triblock | −1.91 | 30 | High Conductivity |
| | 126 | Copolymer | −2.27 | 32 | |

FIG. 3 illustrates the consistently higher mobilities obtained after 2 days for cyan developers prepared from the cyan liquid toner concentrate of Example I and charged with the ABA multiple block ammonium bromide salt copolymer charge director of Example IX versus the same cyan developers except they were charged with the corresponding AB diblock ammonium bromide salt copolymer charge director of Example VII. FIG. 4 illustrates the same trend for the same cyan developers after 114 or 126 days indicating that the charging advantage obtained with the multiple block ammonium bromide salt copolymer charge director was maintained for a prolonged time period.

CONTROL 3

MAGENTA AND CYAN LIQUID DEVELOPERS CHARGED WITH AB DIBLOCK AMMONIUM CARBOXYLATE ZWITTER ION COPOLYMER CHARGE DIRECTORS

A magenta liquid toner dispersion was prepared by selecting 27.82 grams of liquid toner concentrate (7.19 percent solids in NORPAR 15®) from Example III and adding to it sufficient NORPAR 15® and 5 percent AB diblock charge director, poly[2-ethylhexyl methacrylate (B block)-co-N,N-dimethyl-N-methylenecarboxylate-N-ammoniumethyl methacrylate (A block)], from Example X to provide a 1 percent solids liquid toner dispersion wherein solids include resin, charge adjuvant, and pigment containing 30 milligrams or 3 percent charge director per gram of toner solids. After equilibrating for 11 days, another 40 milligrams or 4 percent charge director per gram of toner solids was added to the initial 200 gram developer formulation to provide this control 3A developer charged at a total of 70 milligrams or 7 percent CD per gram toner solids. The 5 percent AB diblock charge director was prepared from Base Polymer Preparation 2 in Example VI.

A cyan liquid toner dispersion was prepared by selecting 27.59 grams of liquid toner concentrate (7.25 percent solids in NORPAR 15®) from Example IV and adding to it sufficient NORPAR 15® and 5 percent AB diblock charge director, poly[2-ethylhexyl methacrylate (B block)-co-N,N-dimethyl-N-methylenecarboxylate-N-ammoniumethyl methacrylate (A block)], from Example X to provide a 1 percent solids liquid toner dispersion wherein solids include resin, charge adjuvant, and pigment containing 15 milligrams or 1.5 percent charge director per gram of toner solids. After equilibrating for 12 days, another 35 milligrams or 3.5 percent charge director per gram of toner solids were added to the initial 200 gram developer formulation to provide this control 3B developer charged at a total of 50 milligrams or 5 percent CD per gram toner solids. The 5 percent AB diblock charge director was prepared from Base Polymer Preparation 2 in Example VI.

Mobility and conductivity were measured for these 1 percent liquid toners to determine the toner charging rate and level. These values were compared to mobility and conductivity values obtained for the 1 percent magenta and cyan liquid toners described in Example XVI. The Example XVI toners contain a lower concentration of ABA multiple block charge director versus the concentration of AB diblock charge director in this control. Table 5 in Example XVI contains both magenta and cyan developer formulations charged with the AB diblock and ABA multiple block copolymer charge directors. The developers were equilibrated for 30 minutes, 1, 7, and 30 or 31 days prior to making the mobility and conductivity measurements. Table 6 in Example XVI contains the corresponding mobility and conductivity values for both magenta and cyan liquid toners or developers.

EXAMPLE XVI

MAGENTA AND CYAN LIQUID DEVELOPERS CHARGED WITH ABA MULTIPLE BLOCK AMMONIUM CARBOXYLATE ZWITTER ION COPOLYMER CHARGE DIRECTOR

A magenta liquid toner dispersion was prepared by selecting 27.82 grams of liquid toner concentrate (7.19 percent solids in NORPAR 15®) from Example III and adding to it sufficient NORPAR 15® and 5 percent ABA multiple block charge director, poly[2-ethylhexyl methacrylate (B block)-co-N,N-dimethyl-N-methylenecarboxylate-N-ammonium-ethyl methacrylate (A block)], from Example XI to provide a 1 percent solids liquid toner dispersion wherein solids include resin, charge adjuvant, and pigment containing 30 milligrams or 3 percent charge director per gram of toner solids. After equilibrating for 11 days, another 20 milligrams or 2 percent charge director per gram of toner solids were added to the initial 200 gram developer formulation to give Example XVIA charged at a total of 50 milligrams or 5 percent CD per gram toner solids. The 5 percent ABA multiple block charge director was prepared from Base Polymer Preparation 3 in Example VII.

A cyan liquid toner dispersion was prepared by selecting 27.59 grams of liquid toner concentrate (7.25 percent solids in NORPAR 15®) from Example IV and adding to it sufficient NORPAR 15® and 5 percent ABA multiple block charge director, poly[2-ethylhexyl methacrylate (B block)-co-N,N-dimethyl-N-methylenecarboxylate-N-ammonium-ethyl methacrylate (A block)], from Example XI to give a 1 percent solids liquid toner dispersion wherein solids include resin, charge adjuvant, and pigment containing 15 milligrams or 1.5 percent charge director per gram of toner solids. After equilibrating for 12 days, another 15 milligrams or 1.5 percent charge director per gram of toner solids were added to the initial 200 gram developer formulation to give Example XVIB charged at a total of 30 milligrams or 3 percent CD per gram toner solids. The 5 percent ABA multiple block charge director was prepared from Base Polymer Preparation 3 in Example VII.

Mobility and conductivity were measured for these 1 percent liquid toners to determine the toner charging rate and level. These values were compared to mobility and conductivity values obtained for the 1 percent magenta and cyan liquid toners described in Control 3. The control 3 developers contain a higher concentration of AB diblock charge director versus these Example XVI developers which contain a lower concentration of ABA multiple block charge director. Table 5 contains both magenta and cyan developer formulations charged with the AB diblock and ABA multiple block copolymer charge directors. The developers were equilibrated for 30 minutes, 1, 7, and 30 or 31 days prior to making the mobility and conductivity measurements. Table 6 contains the corresponding mobility and conductivity values for both magenta and cyan liquid toners or developers.

TABLE 5

MAGENTA AND CYAN LIQUID DEVELOPER FORMULATIONS CHARGED WITH AB DIBLOCK AND ABA MULTIPLE BLOCK AMMONIUM CARBOXYLATE ZWITTER ION COPOLYMER CHARGE DIRECTORS

| Developer ID: Control or Example No. | Liquid Toner Pigment | Grams Toner Concentrate From Exam. III or IV | Grams Added NORPAR 15 ® | Grams Added 5% CD in NORPAR 15 ® (2 Additions) | CD Preparation Example No. and Total CD Level in mg CD/g Toner Solids |
|---|---|---|---|---|---|
| Control 3A | Magenta | 27.82 Exam. III | 170.98 | 1.20 + 1.60 | Example X: 70/1 AB |
| Example XVIA | Magenta | 27.82 Exam. III | 170.98 | 1.20 + 0.80 | Example XI: 50/1 ABA |
| Control 3B | Cyan | 27.59 Exam. IV | 171.81 | 0.60 + 1.40 | Example X: 50/1 AB |
| Example XVIB | Cyan | 27.59 Exam. IV | 171.81 | 0.60 + 0.60 | Example XI: 30/1 ABA |

TABLE 6

MOBILITY AND CONDUCTIVITY RESULTS FOR MAGENTA AND CYAN LIQUID DEVELOPERS CHARGED WITH AB DIBLOCK AND ABA MULTIPLE BLOCK AMMONIUM CARBOXYLATE ZWITTER ION COPOLYMER CHARGE DIRECTORS

| Developer ID: Control or Example No. (Pigment) | Aging Time in (Min.) Days | Total CD Level: mg CD/g Toner Solids | Mobility: E-10 $m^2/Vs$ | Cond: pmho/cm | Comments |
|---|---|---|---|---|---|
| Control 3A | (30) | 70/1 | −1.87 | 11 | Intermediate to |
| (Magenta) | 1 | AB | −2.00 | 9 | High Charging |
| | 7 | Diblock | −2.31 | 9 | and Medium |
| | 31 | Copolymer | −2.55 | 8 | Conductivity |
| Example | (30) | 50/1 | −2.88 | 12 | Very High |
| XVIA | 1 | ABA | −2.80 | 11 | Charging and |
| (Magenta) | 7 | Triblock | −3.17 | 11 | Medium |
| | 31 | Copolymer | −3.26 | 11 | Conductivity |
| Control 3B | (30) | 50/1 | −1.84 | 14 | Intermediate |
| (Cyan) | 1 | AB | −1.69 | 14 | Charging and |
| | 7 | Diblock | −1.77 | 14 | High |
| | 30 | Copolymer | −1.75 | 14 | Conductivity |
| Example | (30) | 30/1 | −2.39 | 16 | High Charging |
| XVIB | 1 | ABA | −2.15 | 16 | and High |
| (Cyan) | 7 | Triblock | −2.27 | 17 | Conductivity |
| | 30 | Copolymer | −2.06 | 18 | |

A review of Table 6 illustrates, for example, that the two Example XVI developers charge more rapidly and to a higher charging level (with only a slight increase in conductivity) versus the corresponding two Control 3 developers. The ABA multiple block ammonium carboxylate zwitter ion copolymer charge directors in the Example XVI developers provide this charging advantage despite their lower concentrations versus the corresponding Control 3 developers containing AB diblock ammonium carboxylate zwitter ion copolymer charge directors at higher concentrations.

CONTROL 4

MAGENTA LIQUID DEVELOPER CHARGED WITH AB DIBLOCK AMMONIUM SULFONATE ZWITTER ION COPOLYMER CHARGE DIRECTOR

A magenta liquid toner dispersion was prepared by selecting 27.82 grams of liquid toner concentrate (7.19 percent solids in NORPAR 15®) from Example III and adding to it 169.78 grams of NORPAR 15® and 2.40 grams of 5 percent AB diblock charge director, poly[2-ethylhexyl methacrylate (B block)-co-N,N-dimethyl-N-methylenecarboxylate-N-ammoniumethyl methacrylate (A block)], from Example XII to provide a 1 percent solids liquid toner dispersion wherein solids include resin, charge adjuvant, and pigment containing 60 milligrams or 6 percent charge director per gram of toner solids. After equilibrating for 12 days, another 60 milligrams or 6 percent charge director per gram of toner solids were added to the initial 200 gram formulation to give this Control 4 developer charged at a total of 120 milligrams or 12 percent CD (charge director) per gram toner solids. The 5 percent AB diblock charge director was prepared from base polymer preparation 2 in Example VI.

EXAMPLE XVII

MAGENTA LIQUID DEVELOPER CHARGED WITH ABA MULTIPLE BLOCK AMMONIUM SULFONATE ZWITTER ION COPOLYMER CHARGE DIRECTOR

A magenta liquid toner dispersion was prepared by selecting 27.82 grams of liquid toner concentrate (7.19 percent solids in NORPAR 15®) from Example III and adding to it 169.78 grams of NORPAR 15® and 2.40 grams of 5 percent ABA multiple block charge director, poly[2-ethylhexyl methacrylate (B block)-co-N,N-dimethyl-N-methylenecarboxylate-N-ammoniumethyl methacrylate (A block)], from Example XIII to provide a 1 percent solids liquid toner dispersion wherein solids include resin, charge adjuvant, and pigment containing 60 milligrams or 6 percent charge director per gram of toner solids. After equilibrating for 12 days, another 30 milligrams or 3 percent charge director per gram of toner solids were added to the initial 200 gram formulation to give this Example XVII developer charged at a total of 90 milligrams or 9 percent CD per gram toner solids. The 5 percent ABA multiple block charge director was prepared from Base Polymer Preparation 3 in Example VII.

Mobility and conductivity were measured for the Control 4 and Example XVII 1 percent liquid developers after equilibrating for 1, 7, and 34 days to determine the toner charging rate and level. The Example XVII developer contains a lower concentration of ABA multiple block charge director versus the concentration of AB diblock charge director in the Control 4 developer. Table 7 contains the corresponding mobility and conductivity values for both magenta and cyan liquid toners or developers.

TABLE 7

MOBILITY AND CONDUCTIVITY RESULTS FOR MAGENTA LIQUID DEVELOPERS CHARGED WITH AB DIBLOCK AND ABA MULTIPLE BLOCK AMMONIUM SULFONATE ZWITTER ION COPOLYMER CHARGE DIRECTORS

| Developer ID: Control or Example No. (Pigment) | Aging Time in Days | Total CD Level: mg CD/g Toner Solids | Mobility: E-10 $m^2/Vs$ | Cond: pmho/cm | Comments |
|---|---|---|---|---|---|
| Control 4 | 1 | 120/1 | −1.40 | 9 | Low Charging |
| (Magenta) | 7 | AB | −1.20 | 7 | and Medium |
| | 34 | Diblock Copolymer | −1.49 | 7 | Conductivity |
| Example 17 | 1 | 90/1 | −1.90 | 9 | Intermediate |
| (Magenta) | 7 | ABA | −1.51 | 9 | Charging and |
| | 34 | Triblock Copolymer | −1.81 | 9 | Medium Conductivity |

A review of Table 7 indicates, for example, that higher charging was obtained (without a significant increase in conductivity) for magenta developers containing a lower concentration of ABA multiple block ammonium sulfonate zwitter ion copolymer charge director versus the corresponding magenta developers containing a higher concentration of AB diblock ammonium sulfonate zwitter ion copolymer charge director.

Alkyl and aryl include methyl, ethyl, propyl, butyl, pentyl, hexyl, heptyl, octyl, nonyl, phenyl, naphthyl, benzyl, and the like.

Other embodiments and modifications of the present invention may occur to those skilled in the art subsequent to a review of the information presented herein; these embodiments and modifications, as well as equivalents thereof, are also included within the scope of this invention.

What is claimed is:

1. A negatively charged liquid electrostatographic developer consisting essentially of a nonpolar liquid, resin particles, pigment, a charge adjuvant, and a nonpolar liquid soluble triblock polymeric ionic charge director ABA wherein A and B represent polymeric segments, and wherein the A block is an ammonium containing segment.

2. A negatively charged liquid developer comprised of a nonpolar liquid, thermoplastic resin particles, a charge director comprised of a triblock polymer of the formula ABA wherein the A block is an ammonium containing segment wherein the A blocks have a number average molecular weight range of from about 200 to about 120,000 and the B block has a number average molecular weight range of from about 2,000 to 190,000.

3. A developer in accordance with claim 2 wherein the A blocks are obtained from the monomers N,N-dimethylamino-N-2-ethyl methacrylate, N,N-diethylamino-N-2-ethyl methacrylate, N,N-dimethylamino-N-2-ethyl acrylate, N,N-diethylamino-N-2-ethyl acrylate, N,N-morpholino-N-2-ethyl methacrylate, N,N-morpholino-N-2-ethyl acrylate, 4-vinyl-pyridine, 2 -vinyl-pyridine, or 3-vinyl pyridine; and wherein said B blocks are obtained from the monomers 2-ethylhexylmethacrylate, 2-ethoxyethyl methacrylate, 2-ethylhexyl acrylate, 2-ethoxyethyl acrylate, lauryl methacrylate, lauryl acrylate, cetyl acrylate, cetyl methacrylate, stearyl methacrylate, stearyl acrylate, butadiene, isoprene, chloroprene, myrcene, piperylene, 1-dodecene, 4-tertiary butylstyrene, or 3-tertiary butylstyrene.

4. A developer in accordance with claim 2 wherein the resin particles are comprised of a copolymer of ethylene and an α-β-ethylenically unsaturated acid selected from the group consisting of acrylic acid and methacrylic acid, or mixtures thereof.

5. A developer in accordance with claim 2 wherein the resin particles are comprised of a styrene polymer, an acrylate polymer, a methacrylate polymer, a polyester, or mixtures thereof.

6. A developer in accordance with claim 2 wherein the resin particles are comprised of a copolymer of ethylene and vinyl acetate, polypropylene, polyethylene, acrylic polymers, or mixtures thereof.

7. A developer in accordance with claim 2 further containing a colorant.

8. A developer in accordance with claim 7 wherein the colorant is a pigment or a dye.

9. A developer in accordance with claim 8 wherein the pigment is cyan, magenta, yellow, red, green, blue, brown, mixtures thereof, or carbon black.

10. A developer in accordance with claim 2 wherein the liquid is an aliphatic hydrocarbon.

11. A developer in accordance with claim 10 wherein the aliphatic hydrocarbon is a mixture of branched hydrocarbons with from about 12 to about 16 carbon atoms.

12. A developer in accordance with claim 10 wherein the aliphatic hydrocarbon is a mixture of normal hydrocarbons with from about 12 to about 16 carbon atoms.

13. An imaging method which comprises forming an electrostatic latent image followed by the development thereof with the liquid developer of claim 2.

14. A developer in accordance with claim 2 wherein the weight average molecular weight to number average molecular weight ratio of said triblock is about 1 to 5.

15. A developer in accordance with claim 2 wherein the total number average molecular weight of said ABA triblock polymer is from about 6,200 to about 300,000.

* * * * *